US008479815B2

(12) United States Patent
Williams

(10) Patent No.: US 8,479,815 B2
(45) **Date of Patent: *Jul. 9, 2013**

(54) DESALINATION SUBSURFACE FEEDWATER SUPPLY AND BRINE DISPOSAL

(75) Inventor: Dennis E. Williams, Altadena, CA (US)

(73) Assignee: GEOSCIENCE Support Services, Inc., La Verne, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/295,990

(22) Filed: Nov. 14, 2011

(65) Prior Publication Data

US 2012/0292012 A1 Nov. 22, 2012

Related U.S. Application Data

(63) Continuation-in-part of application No. 12/748,886, filed on Mar. 29, 2010, now Pat. No. 8,056,629.

(60) Provisional application No. 61/293,134, filed on Jan. 7, 2010.

(51) Int. Cl.
*E21B 43/10* (2006.01)
*E21B 43/04* (2006.01)
*E02B 11/00* (2006.01)

(52) U.S. Cl.
USPC ..... 166/278; 166/369; 166/51; 166/54.1; 166/105.1; 405/43; 405/47; 405/48; 405/50

(58) Field of Classification Search
USPC ..... 166/278, 369, 374, 51, 54.1, 74, 166/105.1; 405/43, 47, 48, 50
See application file for complete search history.

(56) References Cited

U.S. PATENT DOCUMENTS

| | | | | | |
|---|---|---|---|---|---|
| 4,014,387 | A | * | 3/1977 | Fink | 166/369 |
| 4,199,272 | A | * | 4/1980 | Lacey | 405/36 |
| 4,296,810 | A | * | 10/1981 | Price | 166/265 |
| 4,372,389 | A | * | 2/1983 | Hamrick et al. | 166/369 |
| 4,407,360 | A | * | 10/1983 | Hamrick | 166/68 |
| 4,714,117 | A | * | 12/1987 | Dech | 166/380 |
| 4,779,682 | A | * | 10/1988 | Pelzer | 166/370 |
| 5,133,411 | A | * | 7/1992 | Gadelle et al. | 166/370 |
| 5,209,605 | A | * | 5/1993 | Cherrington | 405/184 |
| 5,343,965 | A | * | 9/1994 | Talley et al. | 175/62 |
| 5,520,247 | A | * | 5/1996 | Gmelig Meyling et al. | 166/245 |
| 5,771,976 | A | * | 6/1998 | Talley | 166/370 |

(Continued)

FOREIGN PATENT DOCUMENTS

WO 01/88332 11/2001

OTHER PUBLICATIONS

Bill Brinker, P.E., Vermillion Angle Well for Lewis & Clark Rural Water System, Apr. 7, 2004.

(Continued)

*Primary Examiner* — Jennifer H Gay
(74) *Attorney, Agent, or Firm* — Sheppard, Mullin, Richter & Hampton LLP

(57) ABSTRACT

A system for supplying water to a desalination plant from a subsurface feedwater supply using one or more slant or horizontally directionally drilled ("HDD") wells, and for concentrate disposal (e.g., injection of brine). A method for constructing a slant or HDD well feedwater supply system for supplying water from a subsurface feedwater supply or to inject concentrate into a subsea aquifer.

52 Claims, 26 Drawing Sheets

U.S. PATENT DOCUMENTS

| | | | | |
|---|---|---|---|---|
| 6,073,659 | A * | 6/2000 | Lange | 138/177 |
| 6,422,318 | B1 * | 7/2002 | Rider | 166/380 |
| 6,581,683 | B2 * | 6/2003 | Ohanesian | 166/236 |
| 6,581,688 | B2 * | 6/2003 | Voll et al. | 166/278 |
| 6,811,353 | B2 * | 11/2004 | Madison | 405/41 |
| 7,000,711 | B2 * | 2/2006 | Miller et al. | 175/65 |
| 7,096,959 | B2 * | 8/2006 | McDonald | 166/369 |
| 7,118,307 | B2 | 10/2006 | Stoecker et al. | |
| 7,207,381 | B2 * | 4/2007 | Sharp | 166/54.1 |
| 7,322,422 | B2 * | 1/2008 | Patel | 166/387 |
| 7,654,343 | B2 * | 2/2010 | Snow | 175/61 |
| 7,699,557 | B2 * | 4/2010 | Shaw et al. | 404/2 |
| 8,056,629 | B2 * | 11/2011 | Williams | 166/278 |
| 2001/0047865 | A1 * | 12/2001 | Voll et al. | 166/250.14 |
| 2002/0033266 | A1 * | 3/2002 | Hester et al. | 166/369 |
| 2002/0189809 | A1 * | 12/2002 | Nguyen et al. | 166/278 |
| 2003/0180094 | A1 * | 9/2003 | Madison | 405/36 |
| 2005/0039907 | A1 * | 2/2005 | Madison | 166/67 |
| 2005/0173124 | A1 * | 8/2005 | McDonald | 166/369 |
| 2005/0173156 | A1 * | 8/2005 | Miller et al. | 175/62 |
| 2006/0127184 | A1 * | 6/2006 | Madison | 405/41 |
| 2006/0260795 | A1 * | 11/2006 | Rescia | 166/51 |
| 2008/0142227 | A1 * | 6/2008 | Yeh et al. | 166/369 |
| 2009/0008092 | A1 * | 1/2009 | Haeberle et al. | 166/278 |
| 2009/0178801 | A1 * | 7/2009 | Nguyen et al. | 166/249 |
| 2009/0241685 | A1 * | 10/2009 | Charette | 73/861.07 |
| 2011/0162850 | A1 * | 7/2011 | Williams | 166/369 |
| 2012/0292012 | A1 * | 11/2012 | Williams | 166/105 |

OTHER PUBLICATIONS

Gary Smith, A New Angle on Well Construction, Approximately 2005.

Dennis E. Williams, The Use of Wells to Provide Water for Seawater Desalination Systems, 15th Annual GRA Meeting and Conference, San Diego, California, Sep. 22, 2006.

Dennis E. Williams, Use of Low Angled Wells for Desalination Feedwater Systems, ASCE Hydrology & Hydraulics Committee Meeting Presentation, Aug. 28, 2007.

Dennis E. Williams, Radial Wells, The Encyclopedia of Water, John Wiley and Sons, 2005.

Mr. Richard Bell, P.E. and Dennis Williams, Ph.D.—Overview of the Dana Point Ocean Desalination Project, May 14, 2008.

Dennis E. Williams, Slant Well Installed and Tested in Dana Point, California, Horizontal News, Summer 2007, vol. 10, No. 1 National Ground Water Association.

Dennis E. Williams, Results of Drilling, Construction, Development and Testing of Dana Point Ocean Desalination Project Test Slant Well, Horizontal News, Summer 2007, vol. 10, No. 1, National Ground Water Association.

California; SoCal SWRO Study Presented, Water Desalination Report, May 18, 2009, vol. 45, No. 19, Media Analytics.

South Coast Coastal Ocean Desalination Project Update, Laguna County Water District—Waves, Jan./Feb. 2009, vol. 5, Issue 1.

Municipal Water District of Orange County, Dana Point Ocean Desalination Project, Project Overview, Apr. 2007.

* cited by examiner

DESALINATION SUBSURFACE FEEDWATER SUPPLY AND BRINE DISPOSAL

CROSS-REFERENCE TO RELATED APPLICATIONS

This is a continuation-in-part of U.S. Pat. No. 8,056,629, filed by Dennis E. Williams on Mar. 29, 2010, which claims priority under 35 U.S.C. §119(e) to U.S. Provisional Application No. 61/293,134, filed by Dennis E. Williams on Jan. 7, 2010. Priority is claimed to these applications, the entire contents of which are herein incorporated by reference.

FIELD OF THE INVENTION

The invention relates generally to the field of supplying water from subsurface intake systems to desalination plants and concentrate disposal (e.g., injection of brine). More specifically, the invention relates to the construction of slant well systems or horizontally directionally drilled ("HDD") well systems to supply water from near-shore or subsea aquifers to desalination plants and to inject concentrate (e.g., desalination process brine) into subsea aquifers.

BACKGROUND OF THE INVENTION

Water developers in California and other coastal communities throughout the world are increasingly considering seawater desalination as a potential source of water for municipal and industrial supply. Limited ground water supplies in the coastal areas, poor inland ground water quality, and decreasing reliability of imported water have made seawater desalination a viable consideration. Seawater desalination has been made even more viable through more cost-effective and efficient subsurface intake systems and water treatment technologies.

Slant well drilling is included in the practice of drilling non-vertical wells. Non-vertical wells are typically used in the petroleum industry and are also known as horizontally directionally drilled wells (HDD wells). Slant wells are also used in other applications, such as drilling beneath roadways or rivers in order to provide conduits for facilities. Slant well desalination subsurface intake systems present significant advantages over traditional open water desalination plant intakes. These advantages include avoidance of entrainment and impingement impacts to marine life, reduction or elimination of costly reverse osmosis pretreatment, and reduction or elimination of permanent visual impacts. Slant well systems are buried systems (i.e. there are little or no visual impacts on the surface), as the wells and connecting pipelines are typically completed below the land surface.

In the past, slant well technology has not been successfully applied to subsea construction of desalination feedwater supplies, as the well screen slots have become clogged during pumping. Once the well screen slot openings are clogged, it becomes difficult or impossible to continue to pump water. Accordingly, there is a need for a reliable slant well system that is able to supply water from near-shore or subsea aquifers to a desalination plant without becoming clogged with fine-grained materials (e.g., fine sands and silts) over time. There is also a need for a method of constructing such a system—especially at low angles below horizontal in order to minimize impacts to inland fresh water sources. The present invention satisfies these needs and provides further related advantages, especially with regard to regulation of feedwater salinity.

SUMMARY OF THE INVENTION

The present invention is embodied in a system for supplying water to a desalination plant from a subsurface feedwater supply using one or more slant wells. The present invention is also embodied in a method for constructing a slant well feedwater supply system for supplying water from a subsurface feedwater supply. A system of angled wells (slant wells) is constructed. In one embodiment, the slant wells obtain a desalination feedwater supply from permeable aquifer systems near and/or beneath a saline water source (i.e., an ocean, sea, or salty inland lake). The slant wells induce recharge of the aquifer system through the floor of the ocean, sea, or inland lake due to the hydraulic head difference between the slant well pumping level and the level of the ocean, sea, or lake. As the supply source is relatively constant, the water supply to such a slant well system generally provides a long-term, sustainable water source for a desalination plant. The slant wells may be constructed at angles that vary from zero to ninety degrees below horizontal.

In one embodiment, the systems and methods discussed here are different from other non-vertical well applications in that they include an engineered, artificially filter-packed, angled well designed specifically to produce a high-capacity, low-turbidity desalination plant feedwater supply source from near-shore and offshore subsurface aquifer systems.

In one embodiment of the invention, the slant wells include a unique telescoping set of casings and screens. This design allows for a larger pump house casing near the land surface, with successively smaller casing and screen diameters as the well extends downward. The telescoping casings and screens facilitate extending the well to lineal lengths of 1,000 feet or greater beneath the floor of the saline water body, with angles below horizontal ranging from zero to ninety degrees.

In other, more detailed features of the invention, the slant well feedwater supply system may comprise a single slant well, an array of two or more slant wells, or multiple arrays of two or more slant wells, the location, spacing, and geometric layout of which may vary among feedwater intake sites depending upon the geohydrologic extent (horizontal and vertical) and characteristics of the subsurface aquifer materials, as well as upon the subsurface aquifer system salinity variation.

In another embodiment of the invention, an engineered artificial filter pack is placed around the well screen portions of the slant wells through a multi-step process that includes:

a. Placing the artificial filter pack in the annular space between the well screen and a temporary casing by pumping the filter pack material under pressure through one or more movable tremie pipes;
b. Placing a movable or temporary packer or blocking assembly within the bore of the well screen section near the portion of the well where the artificial filter pack is being placed;
c. Pumping water through the center of the well-screen packer assembly so that the water exits the well screen below the packer assembly and travels out of the well screen into the filter pack (water injection through the well-screen packer assembly helps to settle the filter pack, as well as ensure that the filter pack completely surrounds the well screen in the annular space between the well screen and the temporary casing);
d. Slowly withdrawing the tremie pipes and well-screen packer assembly up the screened portion of the well so that the artificial filter pack is placed along the length of the screened portion; and e. Simultaneously withdrawing the temporary casing surrounding the well screen and filter pack by pulling, rocking and/or vibrating the casing.

Placement of the engineered artificial filter pack around the screened portions of the slant well helps stabilize the subsea aquifer materials and prevent migration of fine sand and silt materials (from subsea aquifers) into the well. This both inhibits the screen portions from becoming clogged and results in a desalination feedwater water quality, as measured by turbidity and silt density indices (a measure of fouling in reverse osmosis desalination systems), that eliminates or minimizes the need for pre-treatment of the water prior to desalination.

In one embodiment, the well screens are centered inside the temporary casings through a system of centralizers or screen centering guides.

The present invention is also embodied in a method of minimizing variations in feedwater salinity, the method comprising providing a plurality of slant wells, each having a different angle below horizontal. Shallower-angled wells tend to produce water having greater salinity, whereas steeper-angled wells tend to produce water having lesser salinity. By varying the amounts of water pumped from shallower-angled wells versus steeper-angled wells, variations in feedwater salinity that occur due to natural variations in the hydrologic cycle can be minimized. Natural variations in the hydrologic cycle (such as wet and dry hydrologic periods) can impact the location of the freshwater-saltwater interface due to variations in fresh water flowing from the land to the ocean, sea, or inland lake.

On one embodiment, multiple well screens are placed in a single slant well to minimize variations in feedwater salinity in that well that occur due to natural variations in the hydrologic cycle. The slant well can be equipped with a submersible pumping system fitted with a dual-packer shroud assembly. Using the dual-packer shroud assembly, the slant well can selectively pump from upper or lower portions of the subsea aquifer, thereby varying feedwater salinity as required to help minimize variations in feedwater salinity due to hydrologic cycles. The dual-packer shroud assembly (DPSA) allows selective production from well screens both above and below the packers (maximum production), well screens above the upper packer only (lower salinity), well screens below the lower packer only (higher salinity), or well screens between the packers (focused salinity).

Embodiments of the present invention include a telescoping slant well feedwater supply system for supplying water from an aquifer. The system comprises a primary well screen for admitting water from the aquifer (the primary well screen oriented along an axis angled below horizontal and having a substantially uniform cross-sectional area); a filter pack substantially surrounding the primary well screen; a pump house casing oriented along the axis, upward of the primary well screen, and having a substantially uniform cross-sectional area; and a submersible pump contained within the pump house casing for pumping water admitted through the primary well screen. The cross-sectional area of the pump house casing is greater than the cross-sectional area of the primary well screen.

In another embodiment, the axis is straight. The system may further comprise a secondary well screen for admitting water from the aquifer, the secondary well screen oriented along the same axis but having a substantially uniform cross-sectional area greater than the cross-sectional area of the primary well screen. The system may additionally comprise a dual-valve assembly contained within the pump house casing. The dual-valve assembly may comprise a first valve for regulating the flow of water from the primary well screen to the submersible pump, and a second valve for regulating the flow of water from the secondary well screen to the submersible pump. In one embodiment, the first valve is a first pneumatic packer, and the second valve is a second pneumatic packer. The system may further comprise a first air line configured to extend from an air pump to the first pneumatic packer for inflating and deflating the first pneumatic packer, and a second air line configured to extend from an air pump to the second pneumatic packer for inflating and deflating the second pneumatic packer. The system may additionally comprise a tertiary well screen for admitting water from the aquifer, the tertiary well screen oriented along the axis between the first valve and the second valve. The dual-valve assembly may further comprise a shroud substantially surrounding the submersible pump. The shroud may have a plurality of holes through which water from the primary or secondary well screens can flow to the submersible pump. The dual-valve assembly may further comprise centering guides attached to the shroud for centering the submersible pump within the shroud.

Embodiments of the present invention also include a method of constructing a slant well feedwater supply system for supplying water from an aquifer. The method comprises the steps of placing a telescoping plurality of casings below a land surface so that the telescoping plurality of casings extends along an axis angled below horizontal to beneath a water body, wherein the telescoping plurality of casings comprises one or more temporary casings; placing a well screen along the axis within the one or more temporary casings so that a space is formed between the well screen and the one or more temporary casings; and placing a filter pack in the space between the well screen and the one or more temporary casings.

In one embodiment, the method further comprises the step of withdrawing the one or more temporary casings. The step of placing the well screen may comprise the step of centering the well screen within the one or more temporary casings using centering guides. In the step of placing a telescoping plurality of casings, the telescoping plurality of casings may comprise a pump house casing. In one embodiment, the pump house casing has an upward end and a downward end, and the step of placing the well screen comprises placing the well screen so that the well screen extends upwardly through the downward end of the pump house casing along the axis. The method may further comprise the step of fitting the downward end of the pump house casing with a seal, the well screen extending upwardly through the seal.

In another embodiment, the step of placing the filter pack comprises the steps of extending one or more tremie pipes to the space between the well screen and the one or more temporary casings, and pumping filter pack material under pressure through the one or more tremie pipes into the space between the well screen and the one or more temporary casings. The step of extending the one or more tremie pipes may comprise the step of positioning the one or more tremie pipes within the one or more temporary casings using tremie pipe guides. In one embodiment, the one or more tremie pipes consist of three tremie pipes, and the step of positioning the tremie pipes comprises spacing the tremie pipes uniformly about the well screen. The step of placing the filter pack may further comprise the steps of placing a packer assembly within the well screen, the packer assembly comprising a packer and a water pipe extending through a hole in the packer, and pumping water through the water pipe to settle the filter pack material. The method may further comprise the step of withdrawing the packer assembly and the one or more tremie pipes. The steps of withdrawing the one or more temporary casings and withdrawing the packer assembly and the one or more tremie pipes may be gradually performed as the steps of pumping and settling filter pack material are performed, so that the filter pack is placed and settled along the length of the well screen.

Embodiments of the present invention also include a method for reducing salinity variation in feedwater supplied from a slant well system comprising an upper well screen and a lower well screen for admitting water from an aquifer, a submersible pump for pumping water admitted through the upper or lower well screens, an upper valve for regulating water flow from the upper well screen to the submersible pump, and a lower valve for regulating water flow from the lower well screen to the submersible pump. The method comprises the steps of controlling the upper valve to inhibit water flow from the upper well screen to the submersible pump if the salinity of the feedwater decreases below a first predetermined threshold, and controlling the lower valve to inhibit water flow from the lower well screen to the submersible pump if the salinity of the feedwater increases above a second predetermined threshold. In one embodiment, the upper valve, in the step of controlling the upper valve, is a first pneumatic packer, and the lower valve, in the step of controlling the lower valve, is a second pneumatic packer.

The embodiments described above may alternatively be implemented using an HDD well.

In another exemplary system that embodies the invention, use of the slant or HDD wells can be used to dispose of water or brine that results from the desalination process. In one embodiment, construction of the slant or HDD well would be the same regardless of its use (extraction well or injection well) and would employ the same method of construction and placement of an artificial filter pack. In some conditions where the subsea aquifer does not require an engineered artificial filter pack, a natural filter pack comprising naturally occurring native (i.e., in situ) materials could be developed around the well screen portions of the slant or HDD well for the extraction (feedwater supply) or injection (concentrate return) process.

Other features of the invention should become more apparent from the following description of the preferred embodiments taken in conjunction with the accompanying drawings, which illustrate, by way of example, the principles of the invention.

BRIEF DESCRIPTION OF THE DRAWINGS

Various embodiments of the present invention will now be described, by way of example only, with reference to the following drawings.

DETAILED DESCRIPTION OF THE PREFERRED EMBODIMENTS

The invention is generally embodied in a slant or HDD well, or system of slant or HDD wells, that produces water from permeable deposits near or beneath saline water bodies (e.g., oceans, seas, or inland lakes) or injects concentrate return into deposits beneath saline water bodies. The invention can provide a long-term, sustainable feedwater supply for a desalination plant with virtually unlimited recharge potential.

Figure 1:
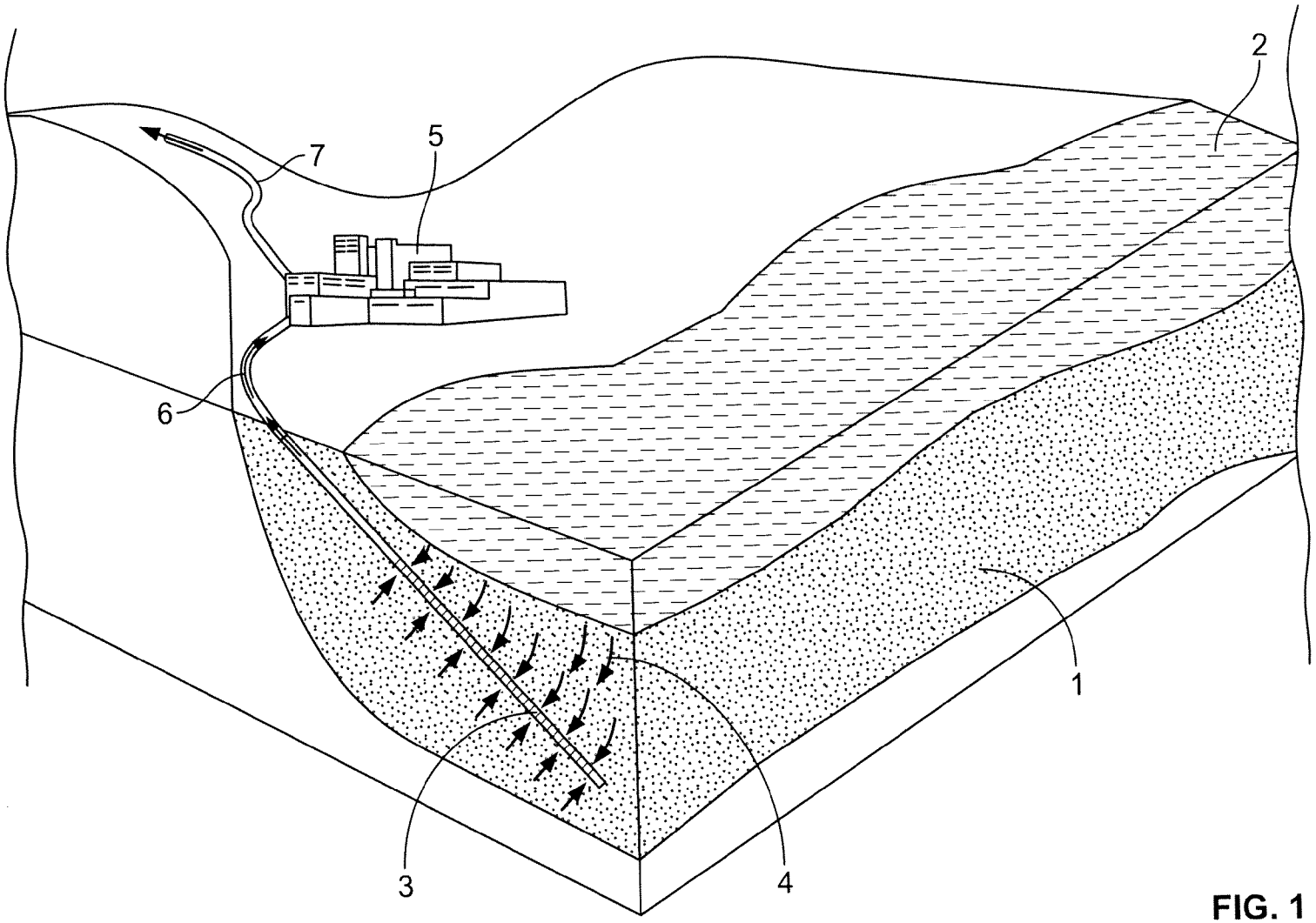
FIG. 1 is an isometric diagram illustrating a slant well feedwater supply system for producing water from a subsurface aquifer system below an ocean floor and pumping the feedwater to an inland desalination plant, in accordance with an embodiment of the present invention. This embodiment may alternatively be implemented using an HDD well.

With reference now to the illustrative drawings, and particularly to FIG. 1, there is shown an isometric diagram illustrating a slant well feedwater supply system for producing water from a subsurface aquifer system below an ocean floor and pumping the feedwater to a desalination plant, in accordance with an embodiment of the present invention. Permeable materials comprising the subsea aquifer 1 are recharged from the overlying ocean 2. The slant well 3 receives recharge from induced infiltration of ocean water 4 and pumps this feedwater to a desalination plant 5 through a pipeline 6. The desalination plant 5 pumps out freshwater through a freshwater pipeline 7 to meet inland water supply demands.

Figure 24:
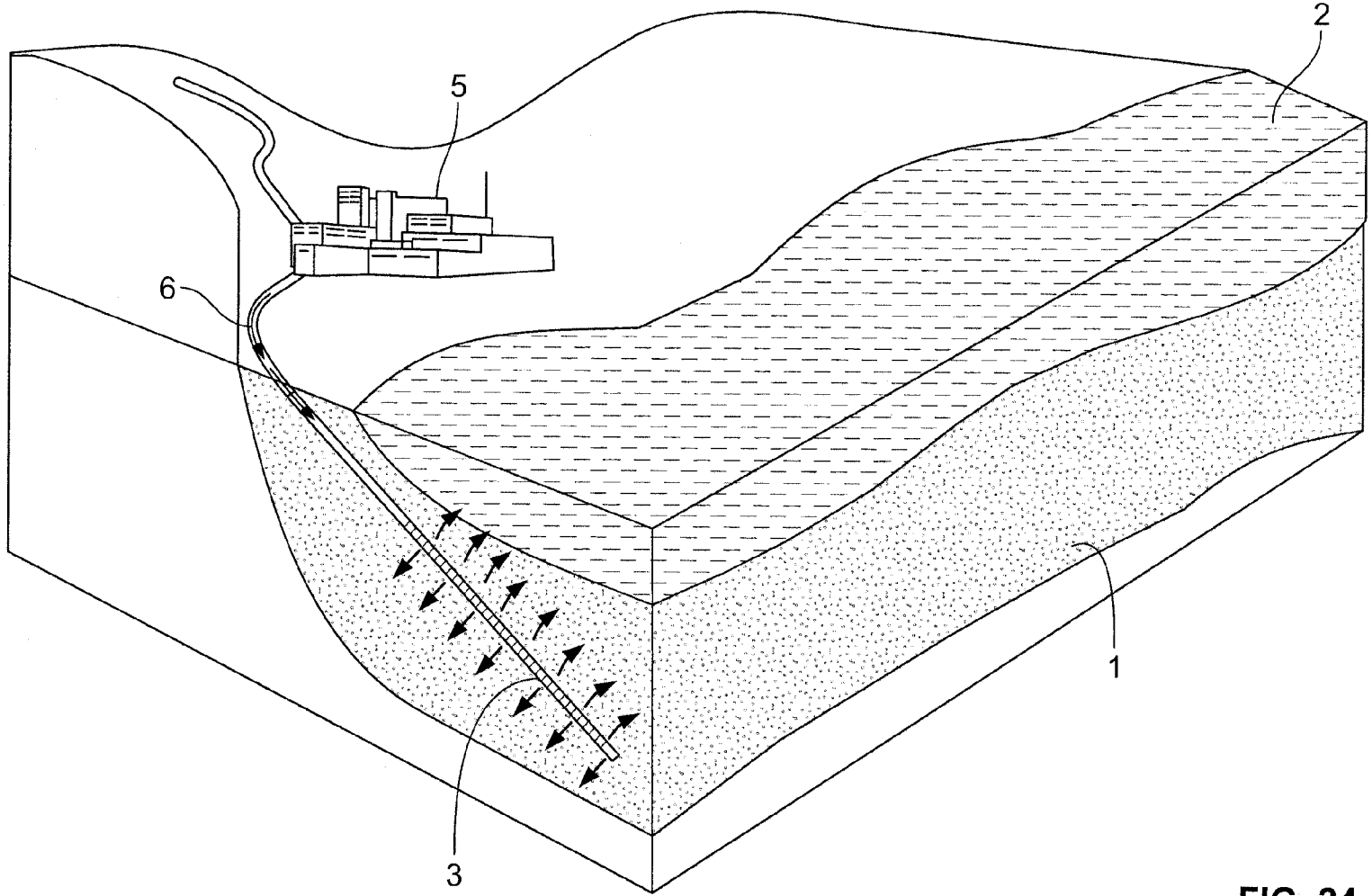
FIG. 24 is an isometric block drawing illustrating a slant or HDD well concentrate disposal system injecting water or brine from a desalination plant into a subsurface aquifer system below the ocean floor.

FIG. 24 shows a slant or HDD well concentrate disposal system from a desalination plant into subsurface materials. Permeable materials comprising the subsea aquifer 1 receive the injected water from the slant or HDD well 3 (or a plurality of slant or HDD wells). The slant or HDD well 3 injects concentrate return from the desalination plant 5. The concentrate return is pumped to the slant or HDD injection well 3 through the pipeline 6.

Figure 25:
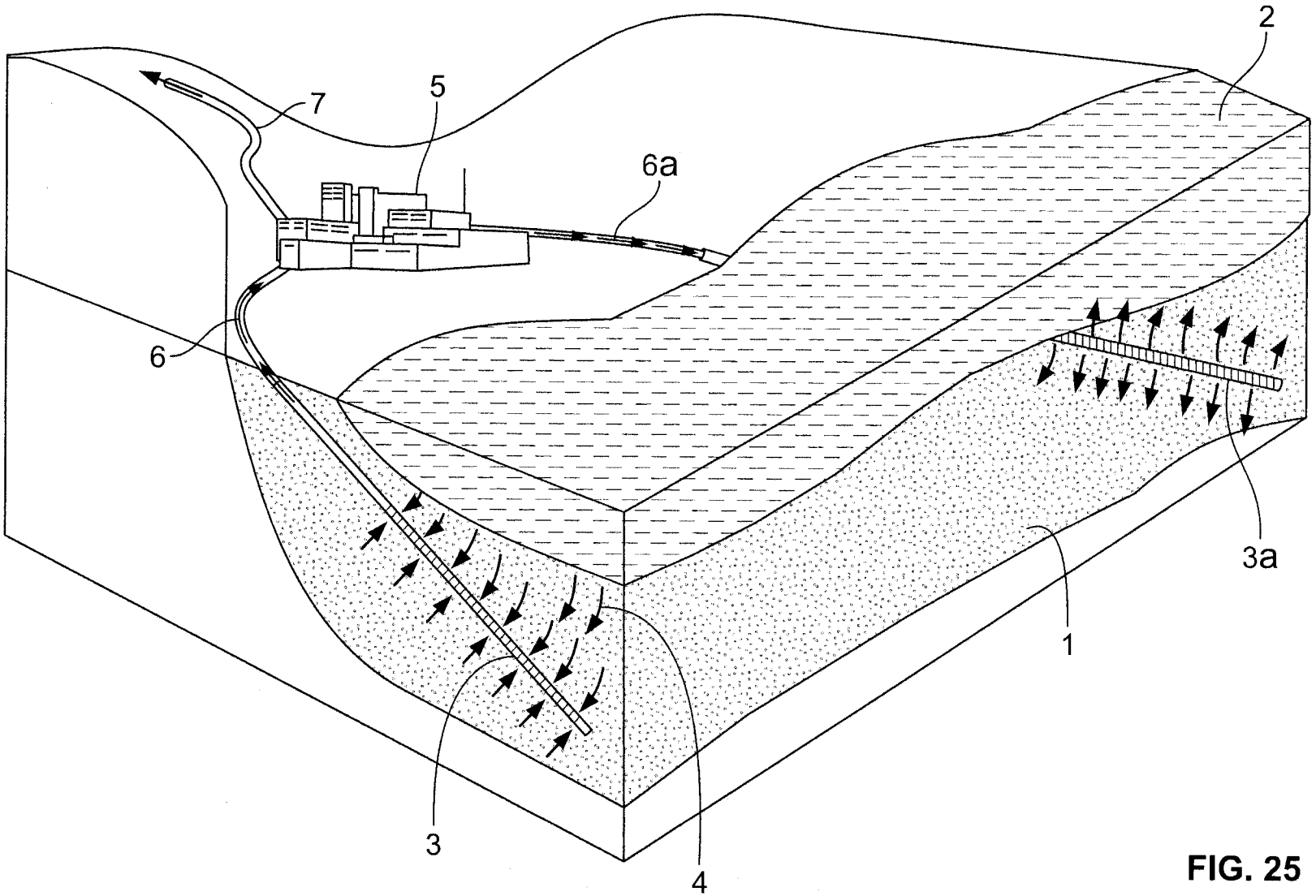
FIG. 25 is an isometric block drawing illustrating a slant or HDD well feedwater supply system and a slant or HDD well concentrate disposal system.

FIG. 25 shows a slant or HDD well feedwater supply system and a slant or HDD well concentrate disposal system. Permeable materials comprising the subsea aquifer 1 supply water to the slant or HDD well 3. Feedwater is pumped to the desalination plant 5 through the pipeline 6. Desalination concentrate return (e.g., brine) is injected into the subsurface aquifer system 1 via the pipeline 6*a* through the concentrate return injection well (slant or HDD) 3*a*.

Figure 2:
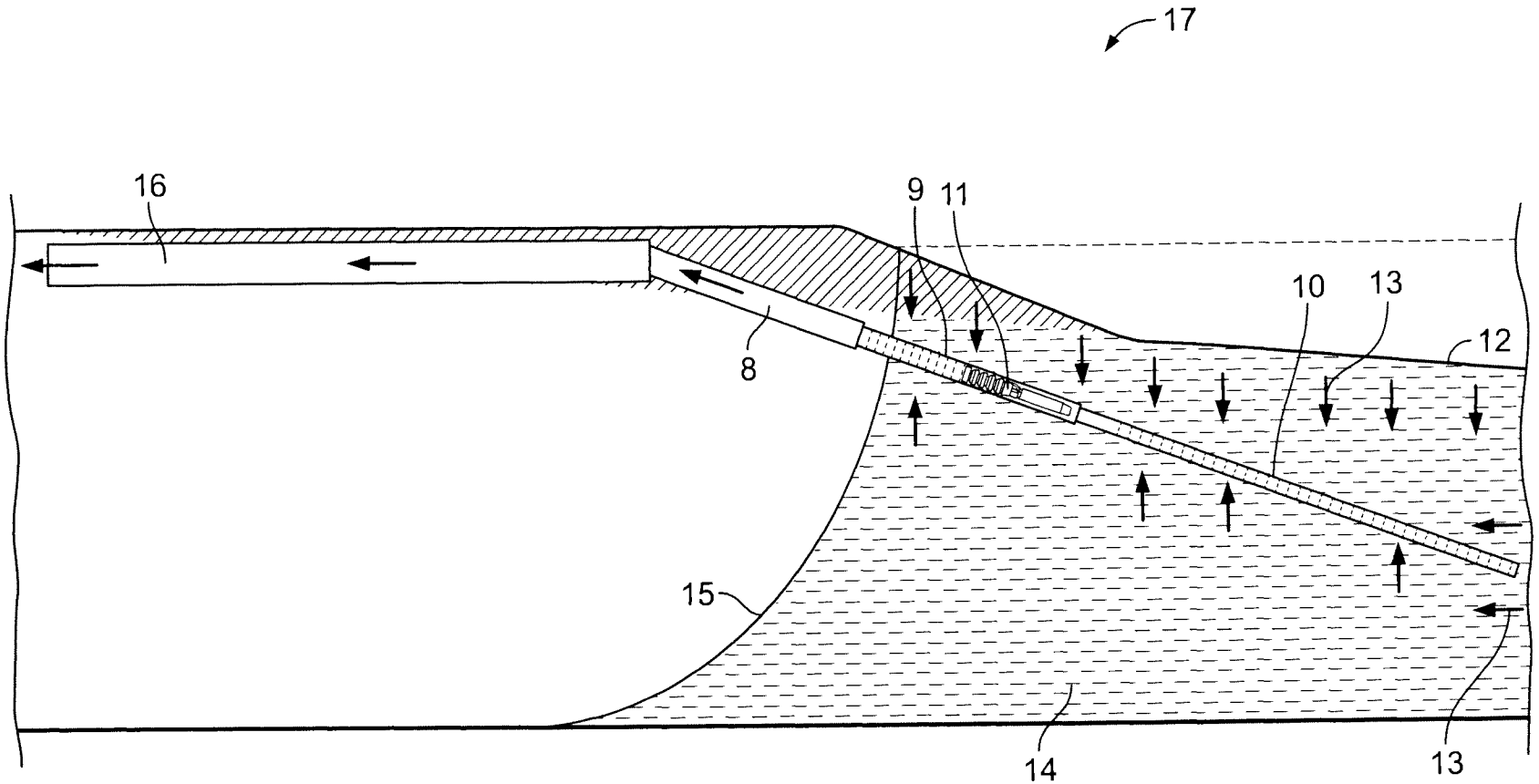
FIG. 2 is a side elevation view of a telescoped slant well having upper and lower well screens and showing water infiltration from the ocean and the freshwater-saltwater interface, in accordance with an embodiment of the present invention, with the aquifers shown in cross-section and the pump house casing cut away to show a submersible pump inside the pump house casing.

With reference now to FIG. 2, there is shown a telescoped slant well 8 configured for use in a feedwater supply system 17, in accordance with an embodiment of the present invention. In one embodiment, the slant well is drilled at a low angle below horizontal using a dual rotary drilling rig or other suitable device to a total lineal length of approximately 1,000 feet or more. In one particular embodiment, the slant well is drilled at an angle of approximately 23 degrees below horizontal. The telescoped slant well has an upper well screen 9 and a lower well screen 10 for admitting water from a saltwater aquifer 14. A submersible pump 11 pumps water out of the slant well to a desalination plant. The slant well is recharged from induced infiltration of water 13 that flows from the ocean floor 12 and lateral offshore sources through the saltwater aquifer 14. The saltwater aquifer meets the freshwater aquifer beneath the land surface at a freshwater-saltwater interface 15. Saline water is pumped from the slant well 8 to the desalination plant via an underground pipeline 16 connected to the buried slant well head. In one embodiment, the buried slant well head is connected to the pipeline 16 via a caisson (not shown) sunk into the land surface.

The slant well 8 is part of a feedwater supply system 17 that comprises the slant well and the pipeline 16. Because the slant well is buried beneath the land surface and ocean floor, the feedwater supply system avoids entrainment and impingement impacts to marine life. Additionally, the filtration process performed by the subsurface aquifer 14 reduces or eliminates costly reverse osmosis pretreatment that would otherwise need to be performed at a desalination plant. Furthermore, because the slant well is completed below the land and ocean surface, aesthetic impacts are minimized or eliminated.

Figure 26:
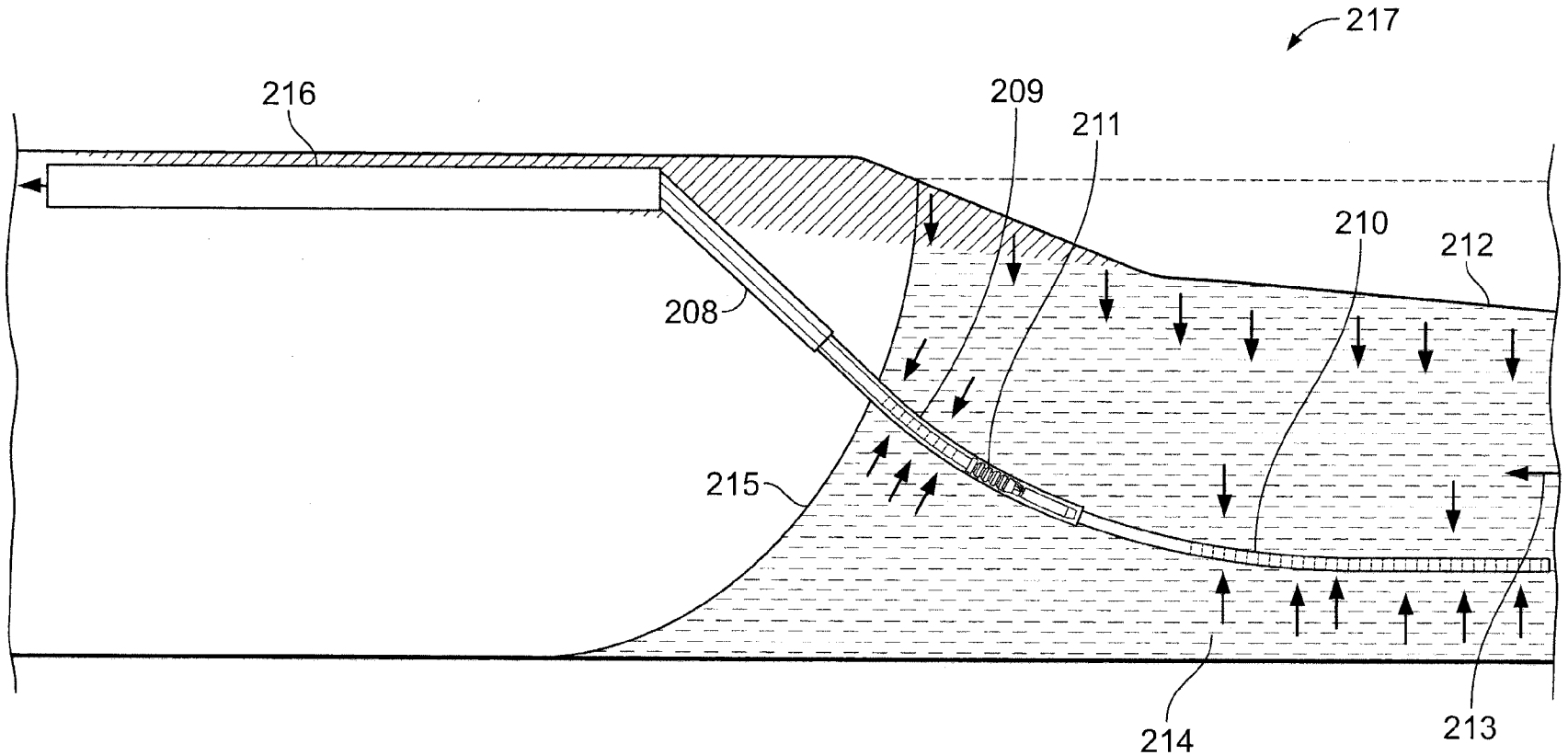
FIG. 26 is a side elevation view of a telescoped HDD well, in accordance with an embodiment of the present invention, with the aquifers shown in cross-section and the pump house casing cut away to show a submersible pump inside the pump house casing.

FIG. 26 shows a telescoping HDD well system 208 completed with two screen sections 209 and 210. The submersible pump 211 pumps water from the well, which is recharged from induced infiltration from the ocean floor 212 and lateral off-shore sources 213 that flow into the salt water aquifer 214. The fresh water-salt water interface is shown by the number 215. Saline water is pumped from the HDD well 208 to the desalination plant via the pipeline 216. The HDD well feedwater supply system 217 avoids entrainment and impingement impacts to marine life. In addition, the filtration process of the subsurface aquifer materials 214 reduces or eliminates costly reverse osmosis pretreatment. Furthermore, the HDD well system may be completed below the land surface to eliminate aesthetic impacts.

Figure 3:
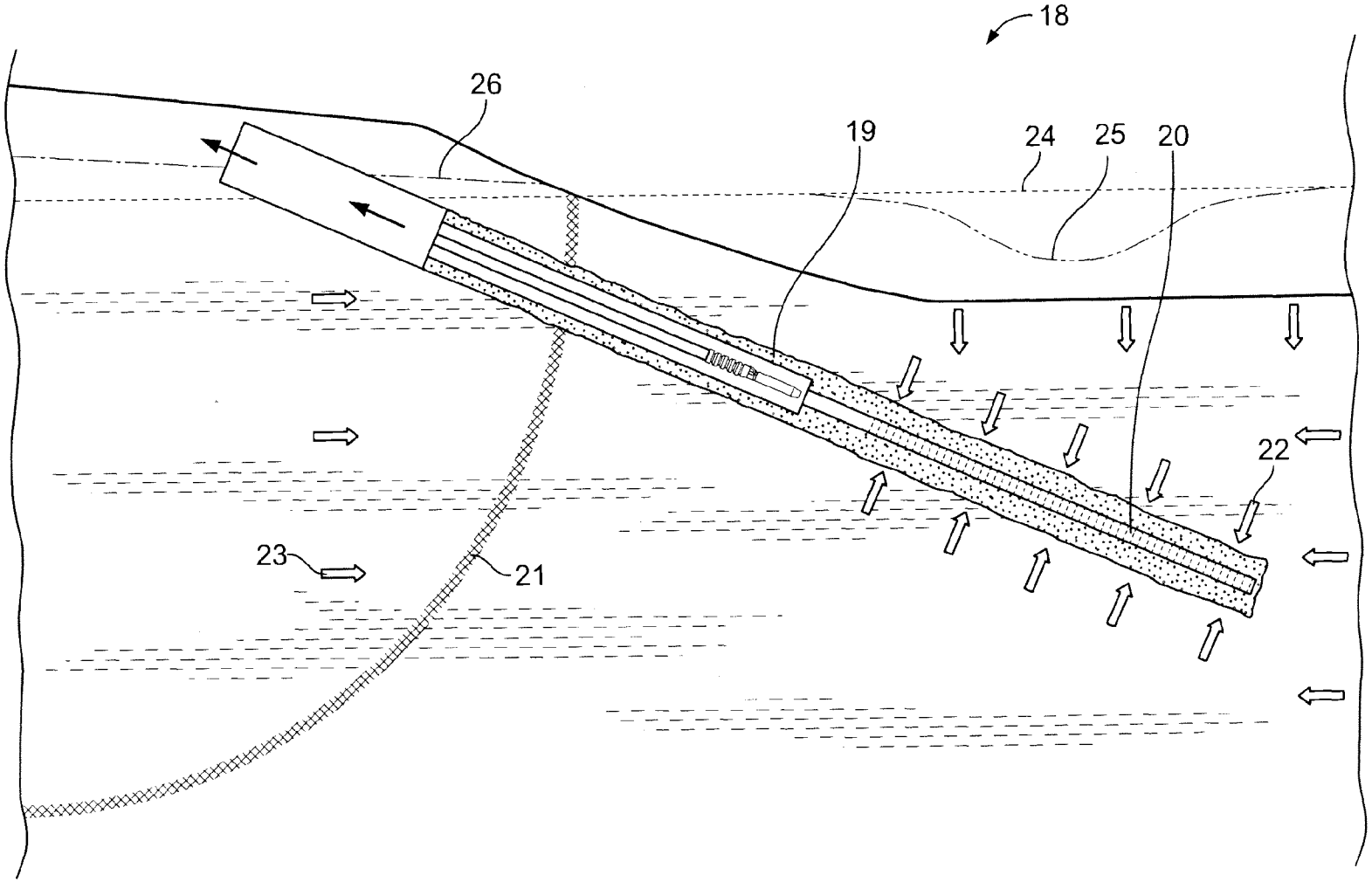
FIG. 3 is a side elevation view of a telescoped slant well having a single well screen interval and showing primary and secondary sources of water recharge to the slant well, in accordance with an embodiment of the present invention, with the aquifers and artificial filter pack surrounding the well screen shown in cross-section, and the pump house casing cut away to show a submersible pump inside the pump house casing.

Various configurations of a slant well for use in a feedwater supply system will now be described in more detail. With reference to FIG. 3, there is shown a telescoped slant well 18 having an artificial filter pack 19 and a single well screen interval 20 in accordance with an embodiment of the present invention. The slant well extends through the freshwater-saltwater interface 21. A primary recharge flow 22 and secondary recharge flow 23 provide recharge to the slant well. Sustained recharge to the slant well is largely provided by induced recharge from the ocean through the primary recharge flow 22 due to the hydraulic head difference between the ocean level 24 and the slant well pumping level 25. The location of the freshwater-saltwater interface 21 is governed by the height of the freshwater elevation 26.

Figure 4:
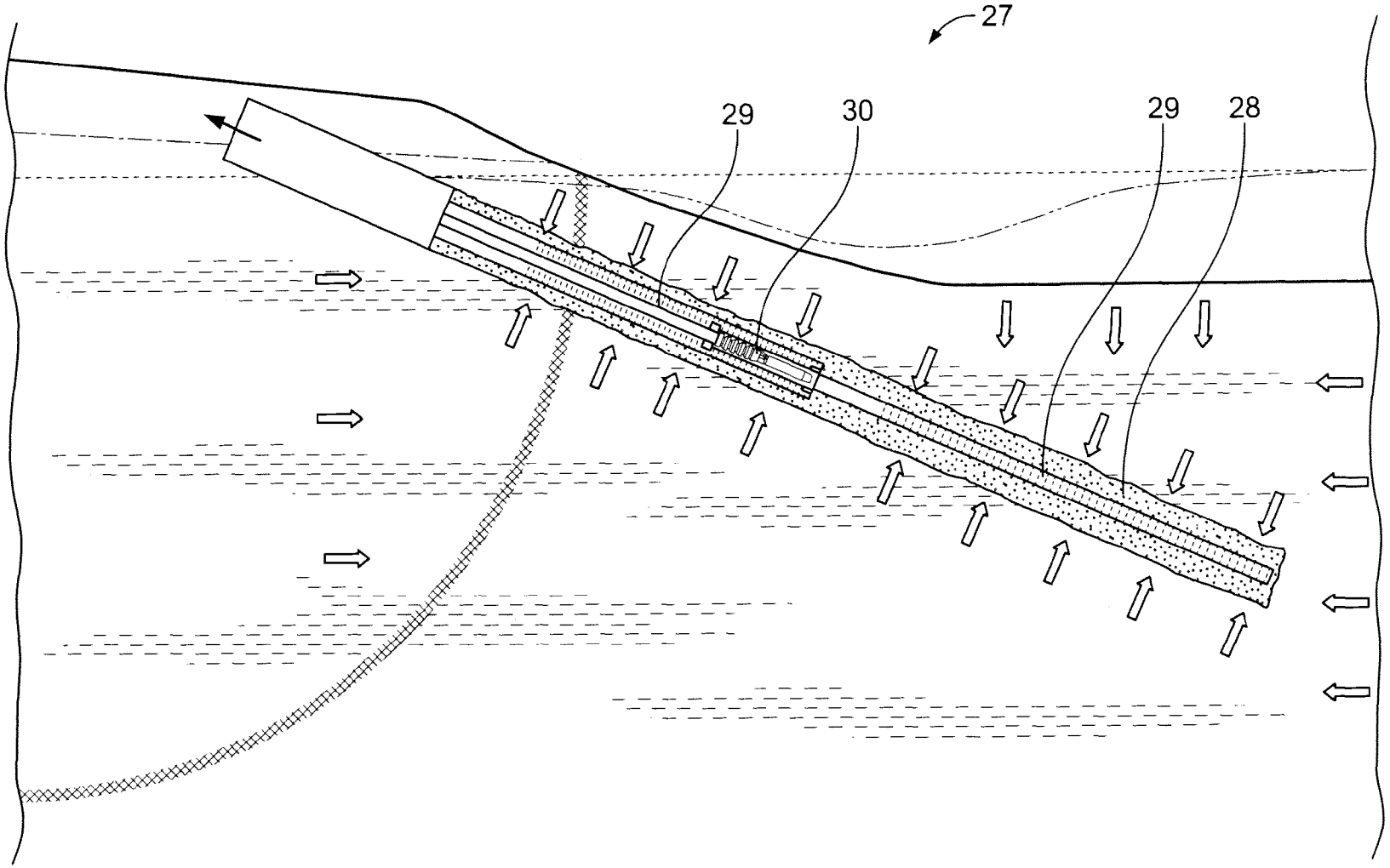
FIG. 4 is a side elevation view of a telescoped slant well having multiple screened intervals, in accordance with an embodiment of the present invention, with the aquifers and artificial filter pack surrounding the well screens shown in cross-section, and the pump house casing cut away to show a submersible pump inside the pump house casing fitted with a dual-packer shroud assembly having both packers deflated for maximum well production.
Figures 5A, 5B, 5C, 5D:
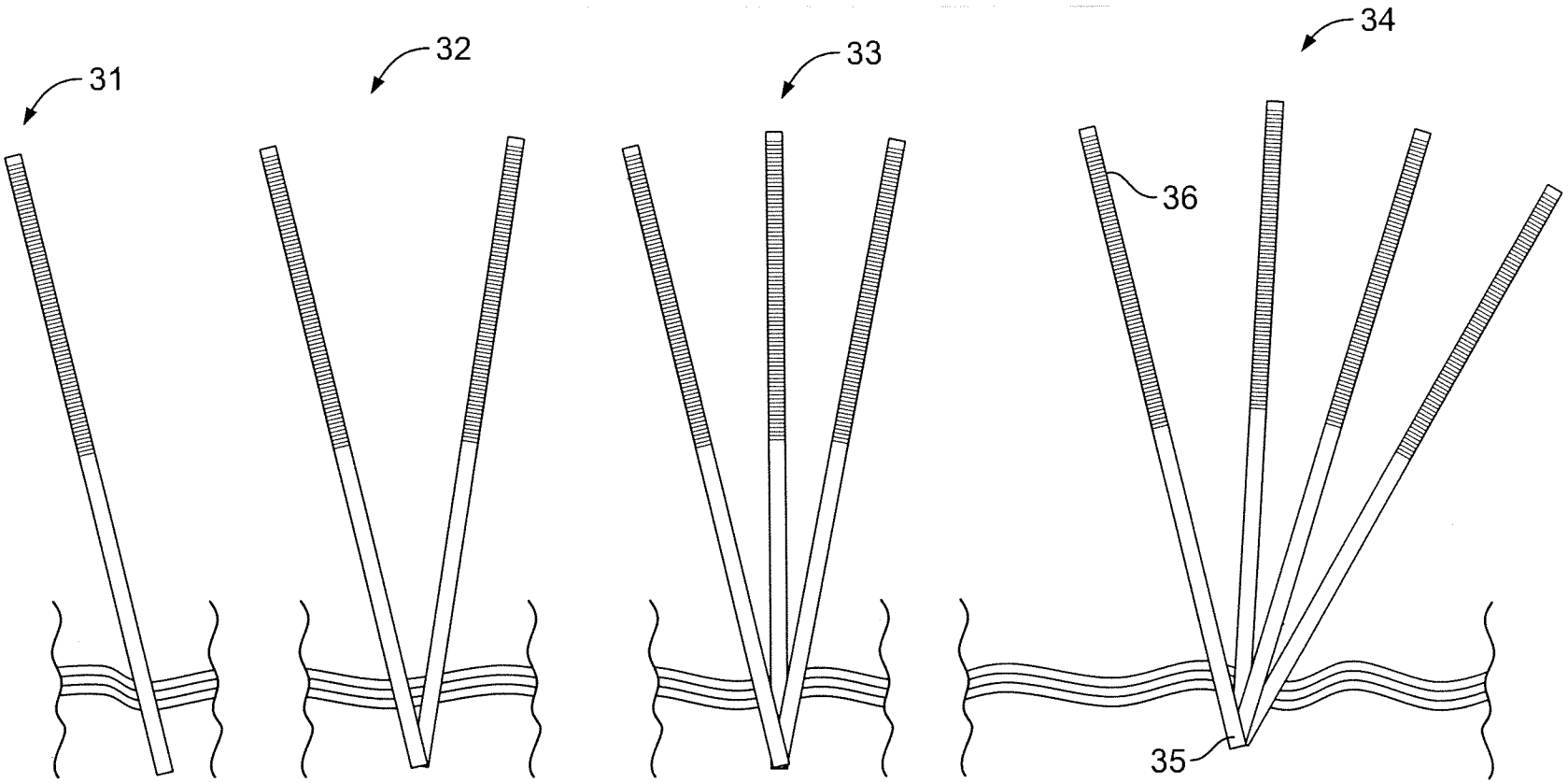
FIGS. 5A-5D are top plan views of four slant well configurations, each having a common well head area for the slant wells in the configuration, the configurations including a single well configuration, a two-well array, a three-well array, and a four-well array, in accordance with embodiments of the present invention.

A slant well in accordance with the present invention can have multiple screened intervals for providing greater flexibility in feedwater production. With reference to FIG. 4, there is shown a telescoped slant well 27 having an artificial filter pack 28, multiple screened intervals 29 (upper and lower), and a submersible pump 30 fitted with a dual-packer shroud assembly, in accordance with an embodiment of the present invention. In the configuration shown in FIG. 4, both of the dual packers are deflated so that water is drawn into the well through both the upper and lower screened intervals. This configuration is for maximum feedwater production. In other configurations, one or both of the dual packers can be inflated so that water is drawn into the well through less than the full length of the screened intervals. These other configurations are described in greater detail below with respect to FIGS. 17-23.

A feedwater supply system in accordance with the present invention can comprise a plurality of slant wells. With reference to FIGS. 5A-5D, there are shown four slant well configurations, each having a common well head area for the slant wells in the configuration, the configurations including a single well configuration 31, a two-well array 32, a three-well array 33, and a four-well array 34, in accordance with embodiments of the present invention. In each configuration, the slant wells all begin in the same vicinity of each other, i.e., they have common well head area 35. As shown in FIGS. 5A-5D, the well head area is located above the high tide line to maximize the undersea screened portion 36 of the slant wells.

Figure 6B:
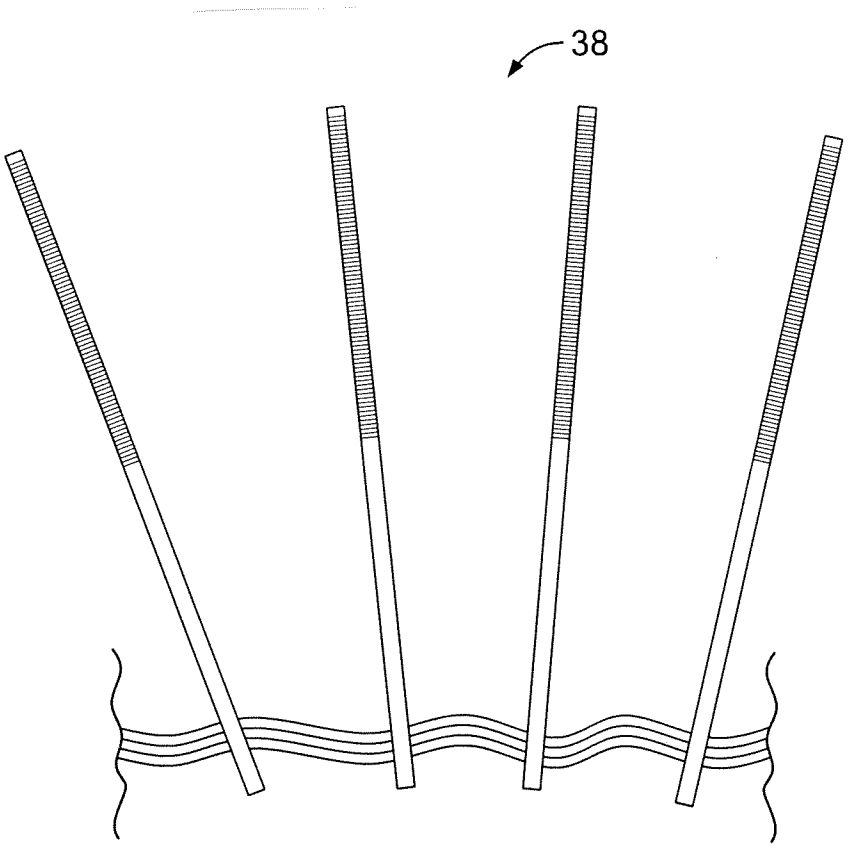
FIGS. 6A and 6B are top plan views of two slant well configurations, each having separate well head areas for the slant wells in the configuration, in accordance with embodiments of the present invention.
Figure 6A:
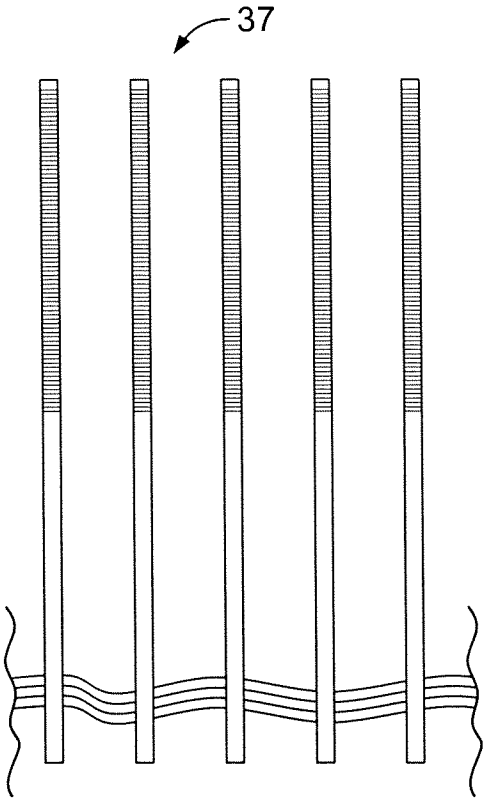

With reference now to FIGS. 6A and 6B, there are shown a parallel slant well configuration 37 and a nonparallel slant well configuration 38, in accordance with embodiments of the present invention. Each of these slant well configurations has a separate well head area for the slant wells in the configuration.

Figure 7:
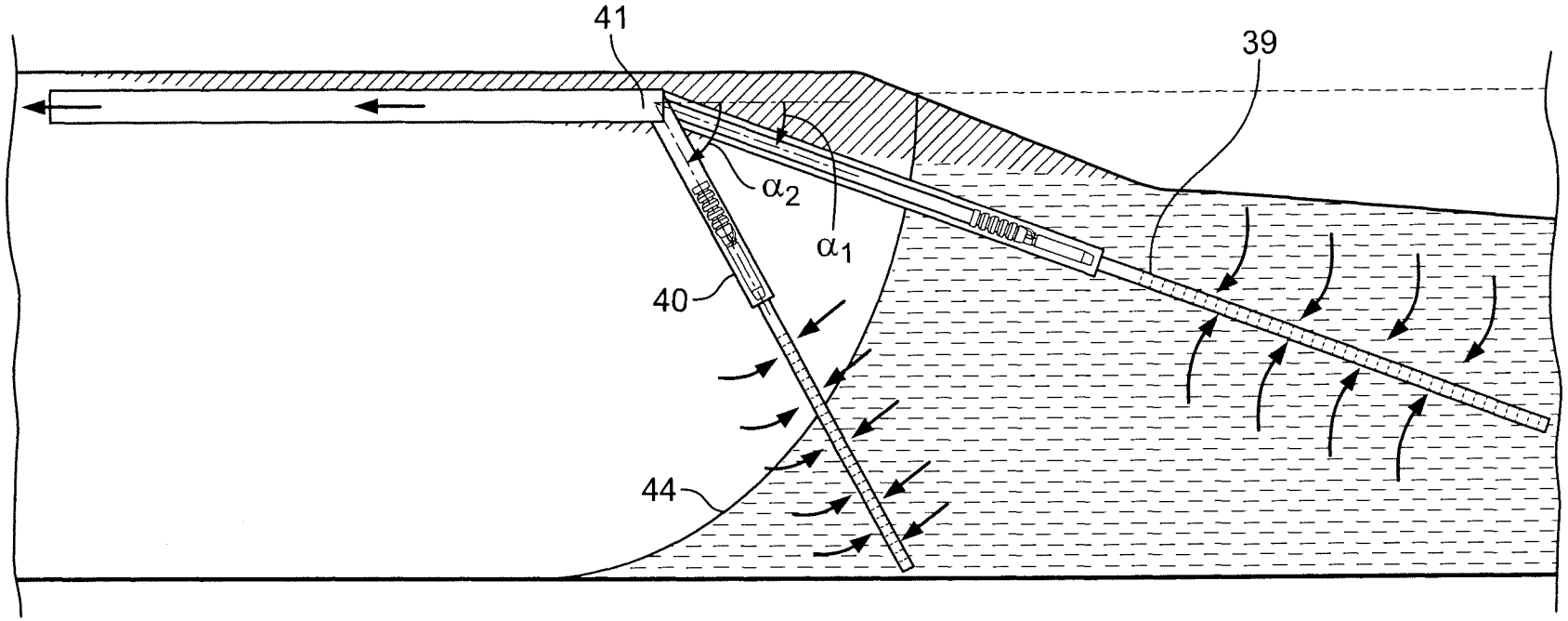
FIG. 7 is a side elevation view showing two telescoped slant wells extending from a common well head but at different angles below horizontal to produce water having different salinities (higher salinity production from the shallower-angle slant well and lower salinity production from the steeper-angle slant well), in accordance with an embodiment of the present invention, with the aquifers shown in cross-section and the pump house casings cut away to show submersible pumps inside the pump house casing.

With reference now to FIG. 7, there are shown a shallower-angle slant well 39 and a steeper-angle slant well 40, the slant wells extending from a common wellhead area 41 but at different angles $\alpha_1$ and $\alpha_2$ below horizontal to produce water having different salinities, in accordance with an embodiment of the present invention. The freshwater-saltwater interface 44 is also shown to illustrate higher salinity production from the shallower-angle slant well 39 and lower salinity production from the steeper-angle slant well 40.

Figure 8:
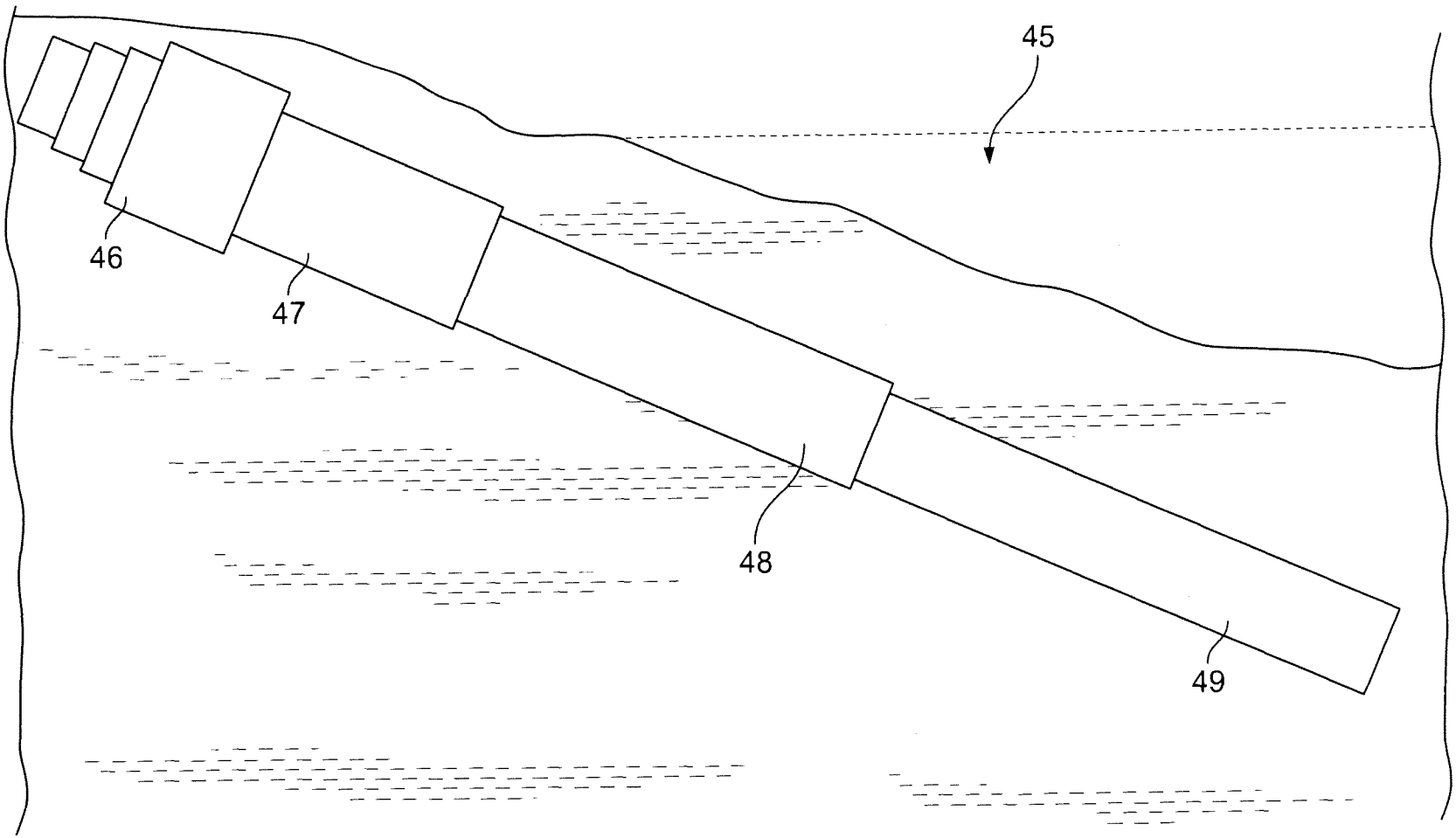
FIG. 8 is a side elevation view of a telescoped slant well having successively reduced casing diameters, the well extending to a lineal length of approximately 1,000 feet, in accordance with an embodiment of the present invention.

Construction of a slant well for use in a feedwater supply system will now be described in more detail. In one embodiment, the initial construction of the slant well involves placing a telescoping plurality of casings beneath the land surface and ocean floor. With reference to FIG. 8, there is shown an initial step in the construction of a telescoped slant well 45 having successively reduced casing diameters, the well extending to a lineal length of approximately 1,000 feet, in accordance with an embodiment of the present invention. The slant well comprises a 26-inch permanent casing 46 for the sanitary seal, a 24-inch permanent pump house casing 47, a 22-inch temporary casing 48, and a 20-inch temporary casing 49.

Figure 9:
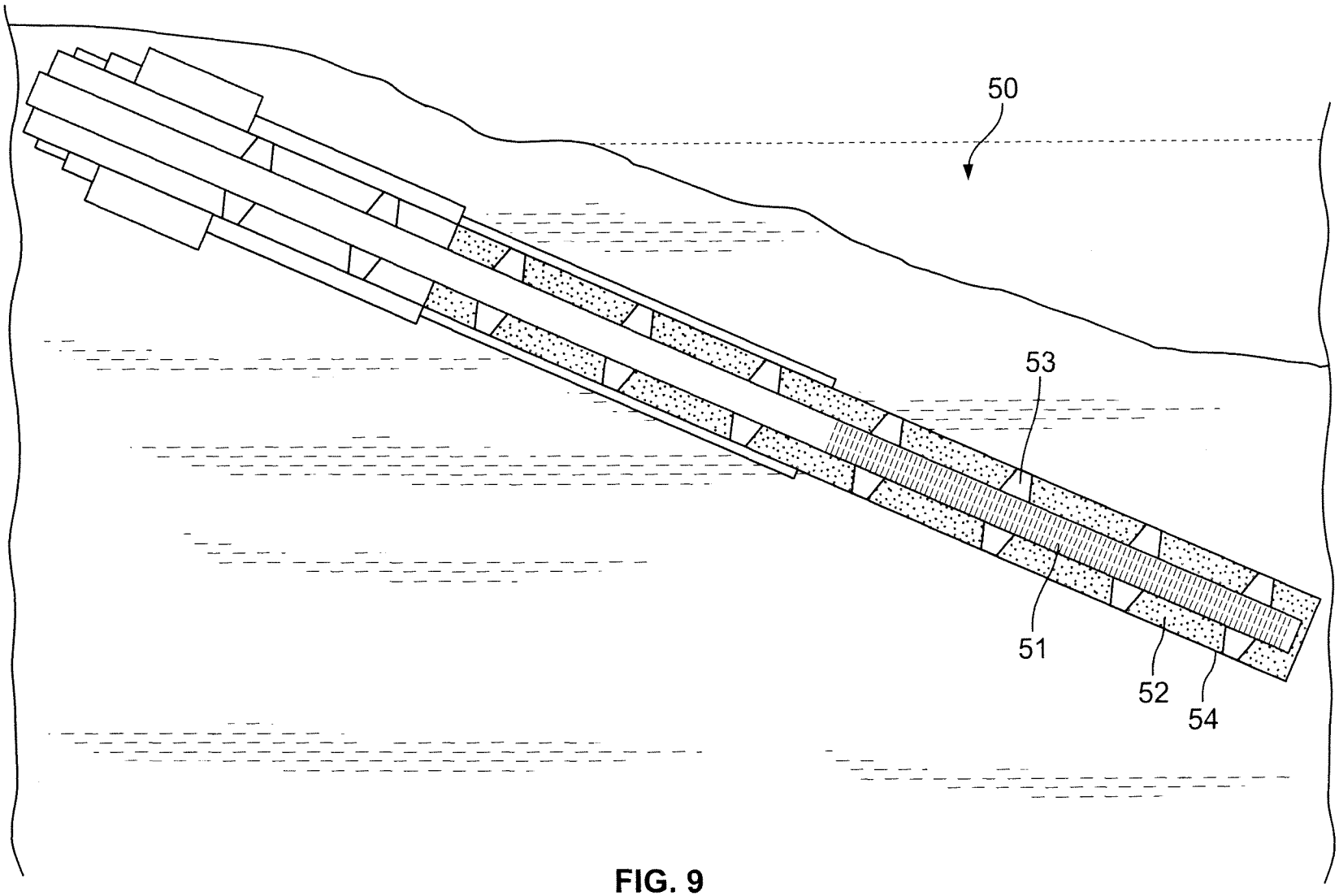
FIG. 9 is a side elevation view of a telescoped slant well showing the placement of a single screened section centered within a temporary casing using centering guides and surrounded by an artificial filter pack, in accordance with an embodiment of the present invention, with the casings, centering guides, and filter pack cut away to show the well screen.

With reference now to FIG. 9, there is shown a second step in the construction of a telescoped slant well 50 having a single 12-inch-diameter well screen section 51, in accordance with an embodiment of the present invention. An artificial filter pack 52 has been placed around the well screen section. The well screen section has been centered within a 20-inch temporary casing 54 using centering guides 53.

Figure 10:
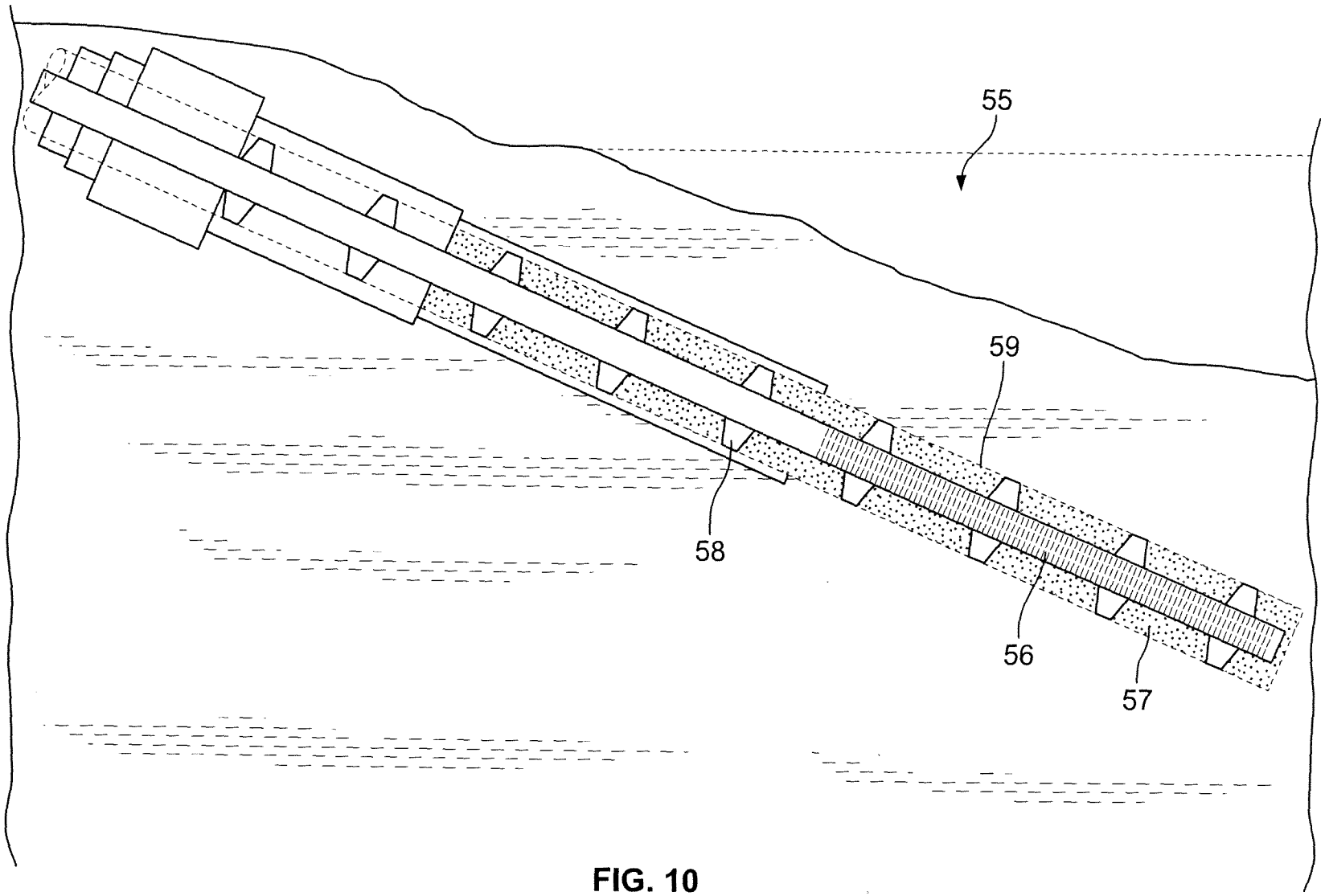
FIG. 10 is a side elevation view of a telescoped slant well illustrating the removal of the 20-inch diameter temporary casing surrounding the well screen and filter pack, in accordance with an embodiment of the present invention, with the casings, centering guides, and filter pack cut away to show the well screen.
Figure 11:
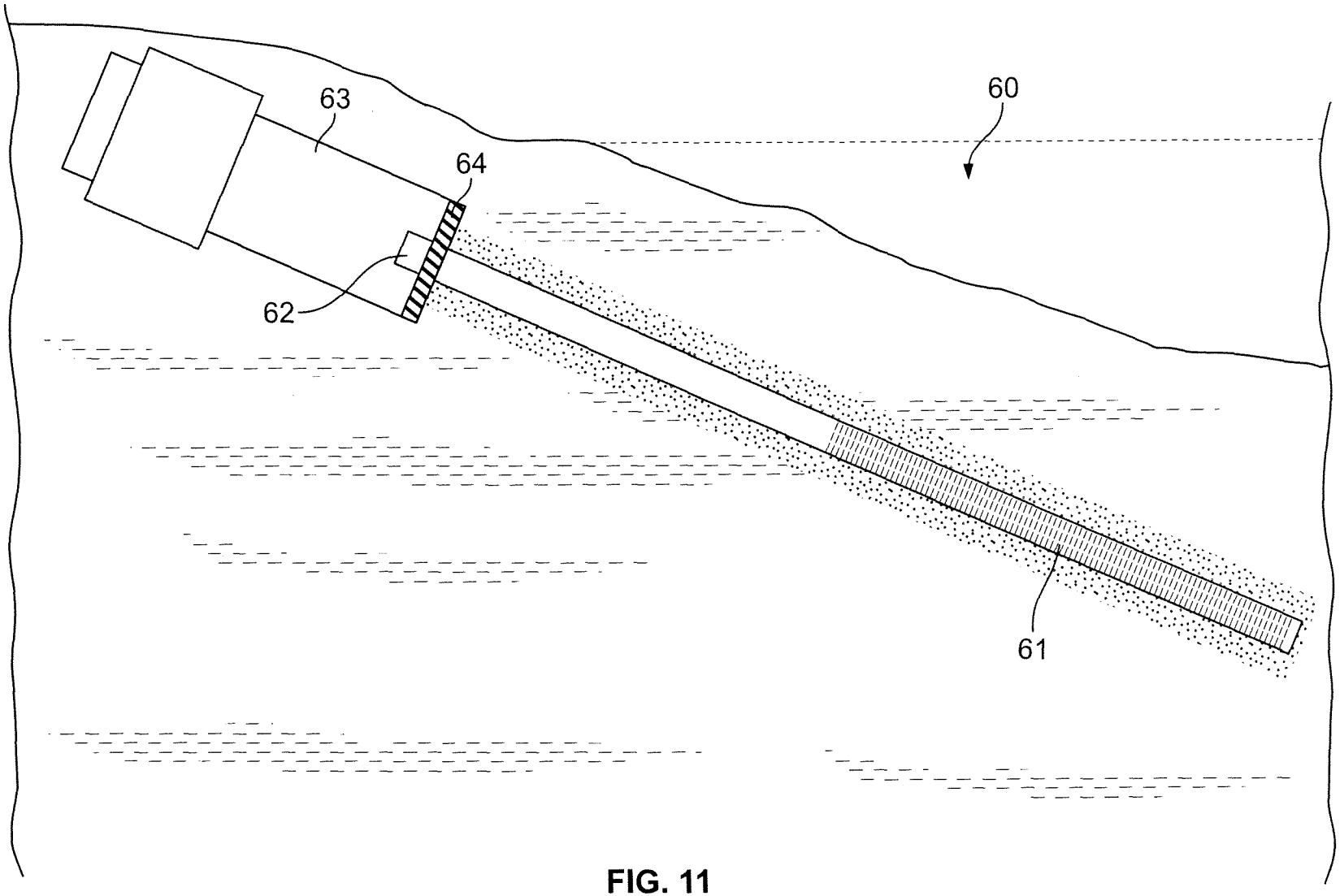
FIG. 11 is a side elevation view of a telescoped slant well having a single screened section with the 20-inch and 22-inch temporary casings removed and a seal placed at the bottom of the 24-inch pump house casing, in accordance with an embodiment of the present invention, with the filter pack cut away to show the well screen.

Before operating a slant well in accordance with the present invention, the temporary casings surrounding the artificial filter pack and well screen section need to be withdrawn. FIGS. 10 and 11 illustrate the process of removing a 20-inch and 22-inch temporary casings from a telescoped slant well having a single well screen section. FIG. 10 shows a telescoped slant well 55 having a single well screen section 56 surrounded by an artificial filter pack 57 and centered using centering guides 58. Dashed line 59 shows the extent of the 20-inch temporary casing prior to the start of the removal process. FIG. 11 shows a telescoped slant well 60 having a single well screen section 61 with both the 20-inch and 22-inch temporary casings removed. The top of the well screen 62 is cut off within the 24-inch pump house casing 63, which is fitted with a seal 64 at the bottom of the pump house casing.

Figure 12:
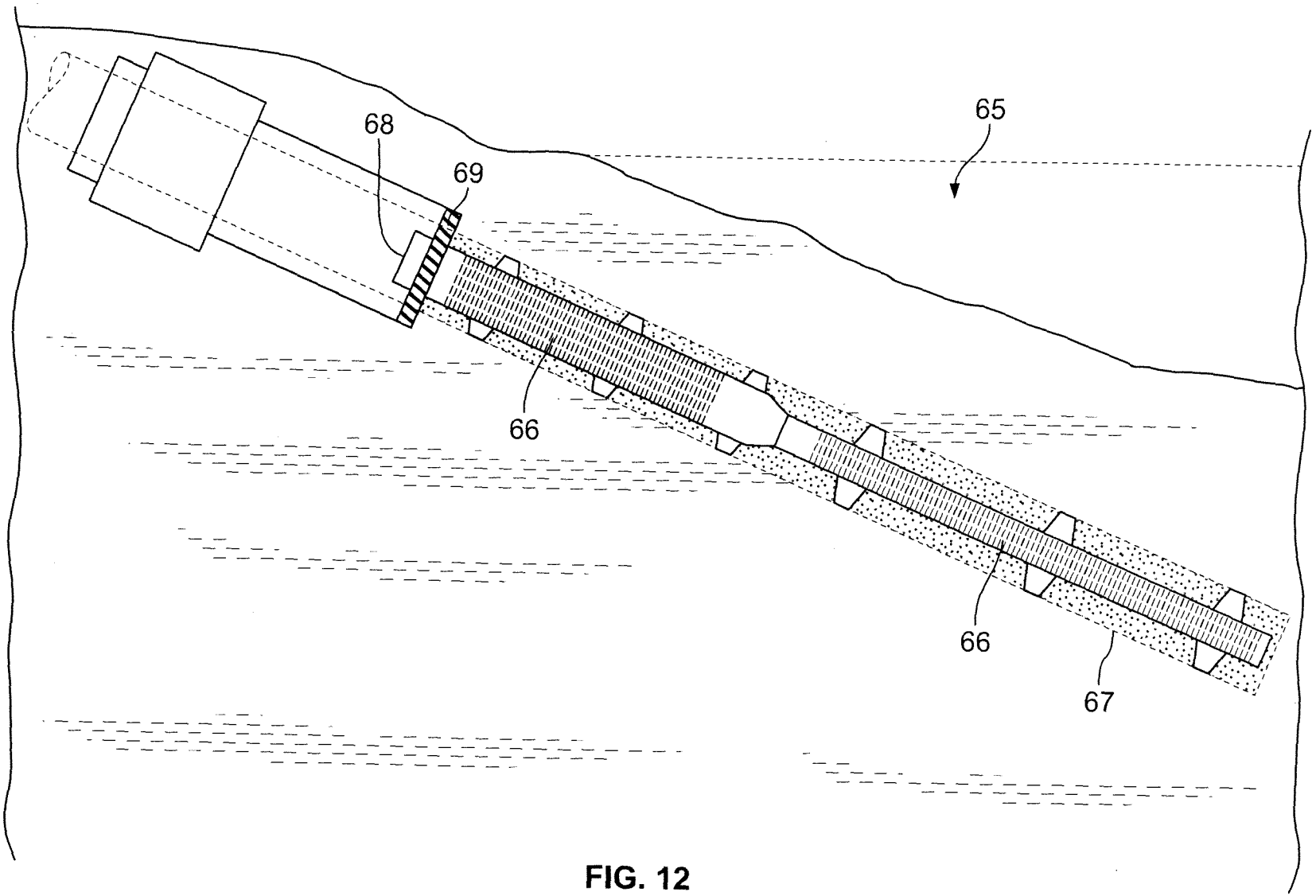
FIG. 12 is a side elevation view of a telescoped slant well having dual screened intervals with the 20-inch and 22-inch temporary casings removed and a seal placed at the bottom of the 24-inch pump house casing, in accordance with an embodiment of the present invention, with the centering guides and filter pack cut away to show the well screen.

With reference now to FIG. 12, there is shown a telescoped slant well 65 having dual screened intervals 66 and the temporary casings removed, in accordance with an embodiment of the present invention. Dashed line 67 shows the extent of the 20-inch temporary casing prior to the start of the removal process. The top of the well screen 68 is cut off within the 24-inch pump house casing, which is fitted with a seal 69 at the bottom of the pump house casing.

Figures 13A, 13B:
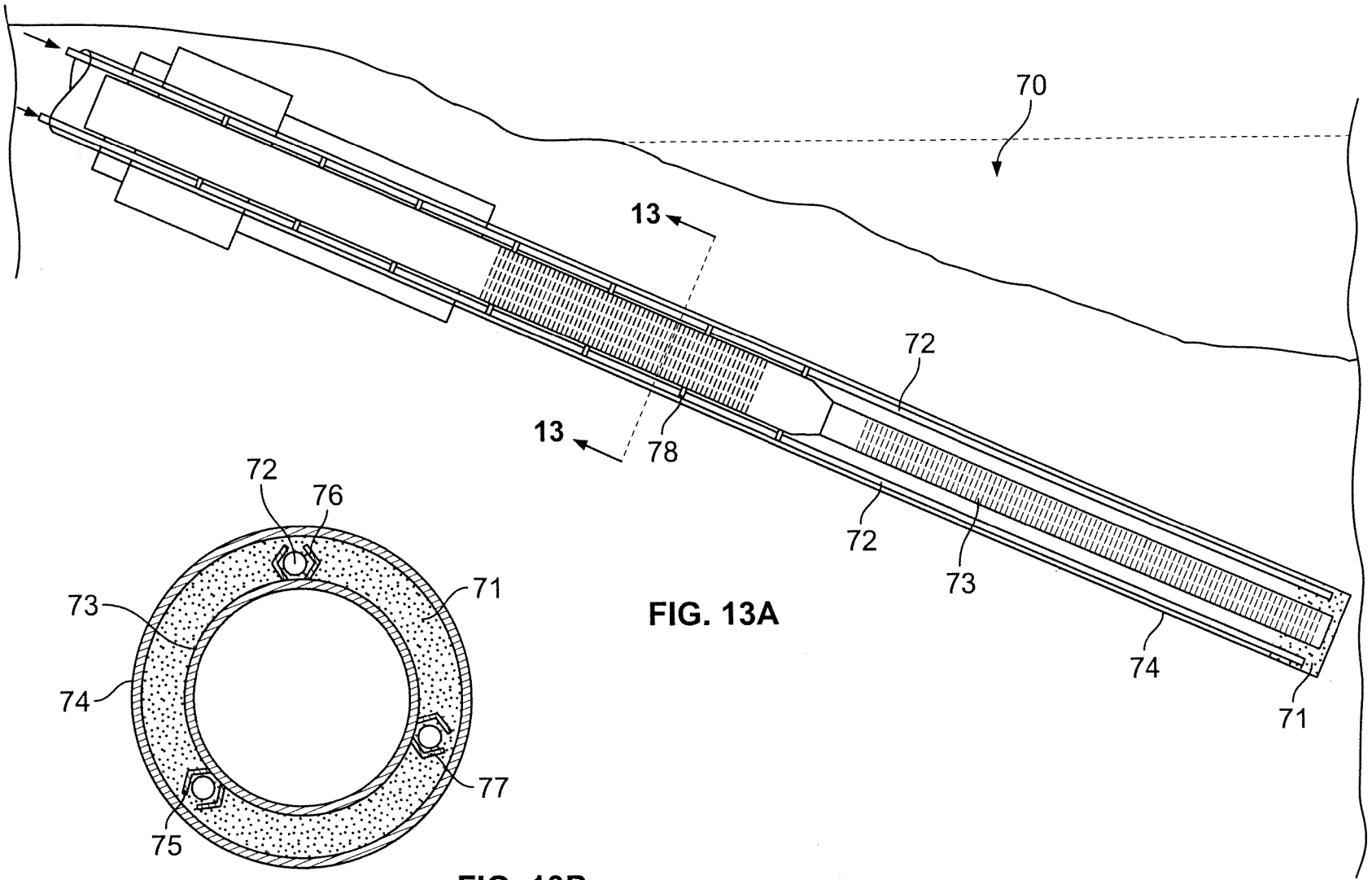
FIG. 13A is a side elevation view of a telescoped slant well showing the placement of an artificial filter pack through a system of multiple tremie pipes in the annular space between the lower well screen and the temporary casing, in accordance with an embodiment of the present invention, with the casings, centering guides, and filter pack cut away to show the tremie pipies and upper and lower well screens.
FIG. 13B is a cross-section view of the telescoped slant well of FIG. 13A, taken along the line 13-13 in FIG. 13A, showing the temporary casing, upper well screen, filter pack, tremie pipes, and tremie pipe guides.

Before completing construction of a slant well in accordance with the present invention, the artificial filter pack needs to be placed and settled around the well screen sections. With reference to FIGS. 13A and 13B, there is shown a telescoped slant well 70 with an artificial filter pack 71 being placed through a system of multiple tremie pipes 72 in the annular space between the lower well screen 73 and the temporary casing 74, in accordance with an embodiment of the present invention. The tremie pipes 72 are positioned using tremie pipe guides 75, 76, 77 and 78.

Figures 14A, 14B:
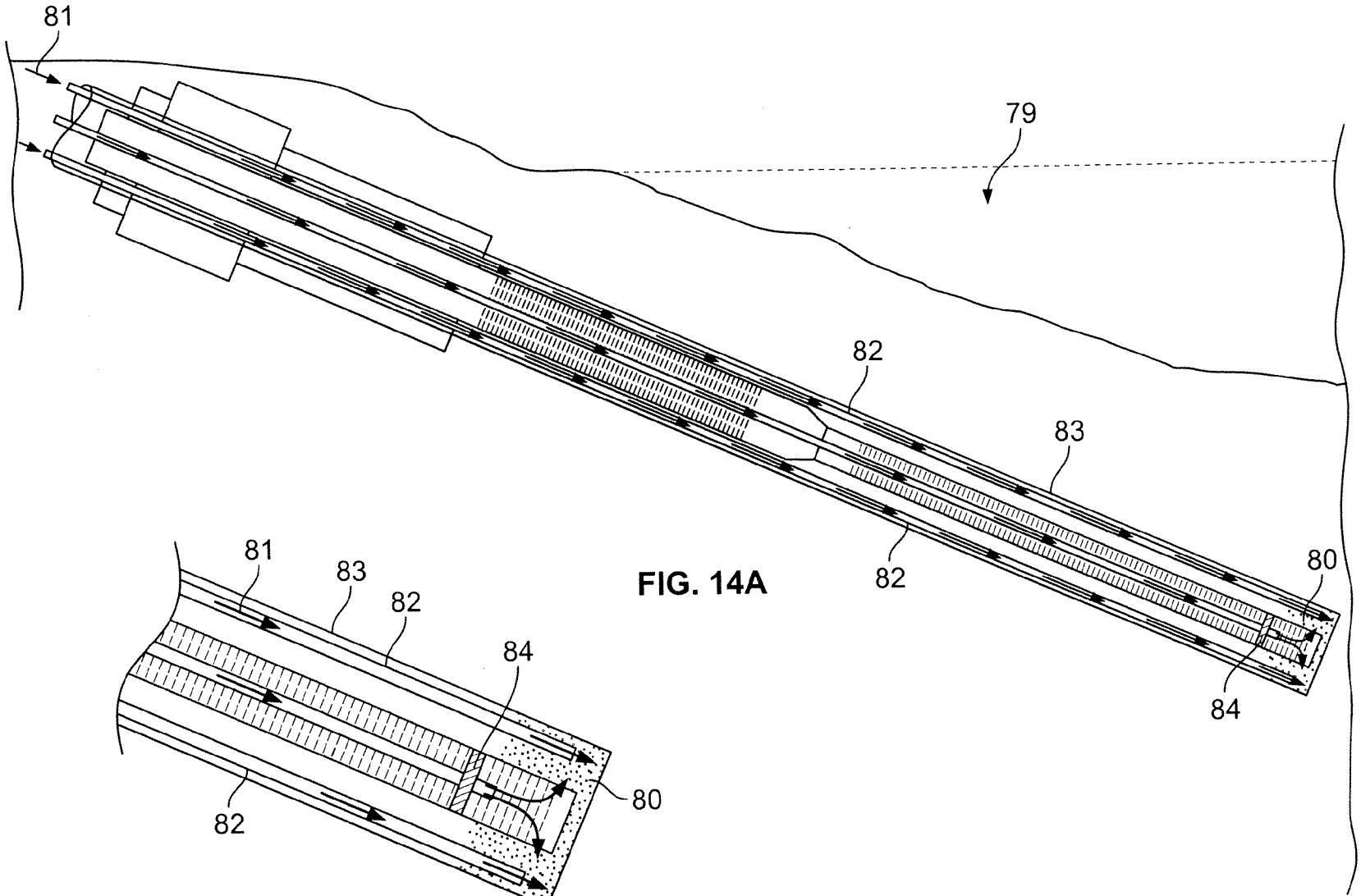
FIG. 14A is a side elevation view of a telescoped slant well showing the placement and settlement of an engineered artificial filter pack through a multi-step process of placing the filter pack by pumping filter pack material through tremie pipes under pressure, simultaneously removing the temporary casing surrounding the tremie pipes, settling the filter pack using an in-screen packer assembly, and gradually withdrawing the in-screen packer assembly, in accordance with an embodiment of the present invention, with the casings and well screens cut away to show the in-screen packer assembly.
FIG. 14B is a detail view of the telescoped slant well of FIG. 14A, showing the filter pack placement.

FIGS. 14A and 14B further illustrate the process of placing and settling the artificial filter pack. These figures show a telescoped slant well 79 with an artificial filter pack 80 being placed and settled through a multi-step process. The filter pack is placed by pumping filter pack material 81 through the multiple tremie pipes 82 under pressure. Simultaneously, the temporary casing 83 surrounding the tremie pipes is removed and the filter pack 80 is settled using an in-screen packer assembly 84. The in-screen packer assembly is configured to be slid inside a well screen. A water pipe extends from a water pump (not shown) through a hole in the in-screen packer. The water pump may be a standard water pump known to persons of ordinary skill in the art, with sufficient flow and pressure to cause water at the depth below the packer to flow outward through the well screen portion below the packer, thereby settling the filter pack in the vicinity of the packer. The in-screen packer assembly and tremie pipes are gradually withdrawn so that the artificial filter pack is placed and settled along the entire length of the well-screen portion of the slant well.

Figure 15:
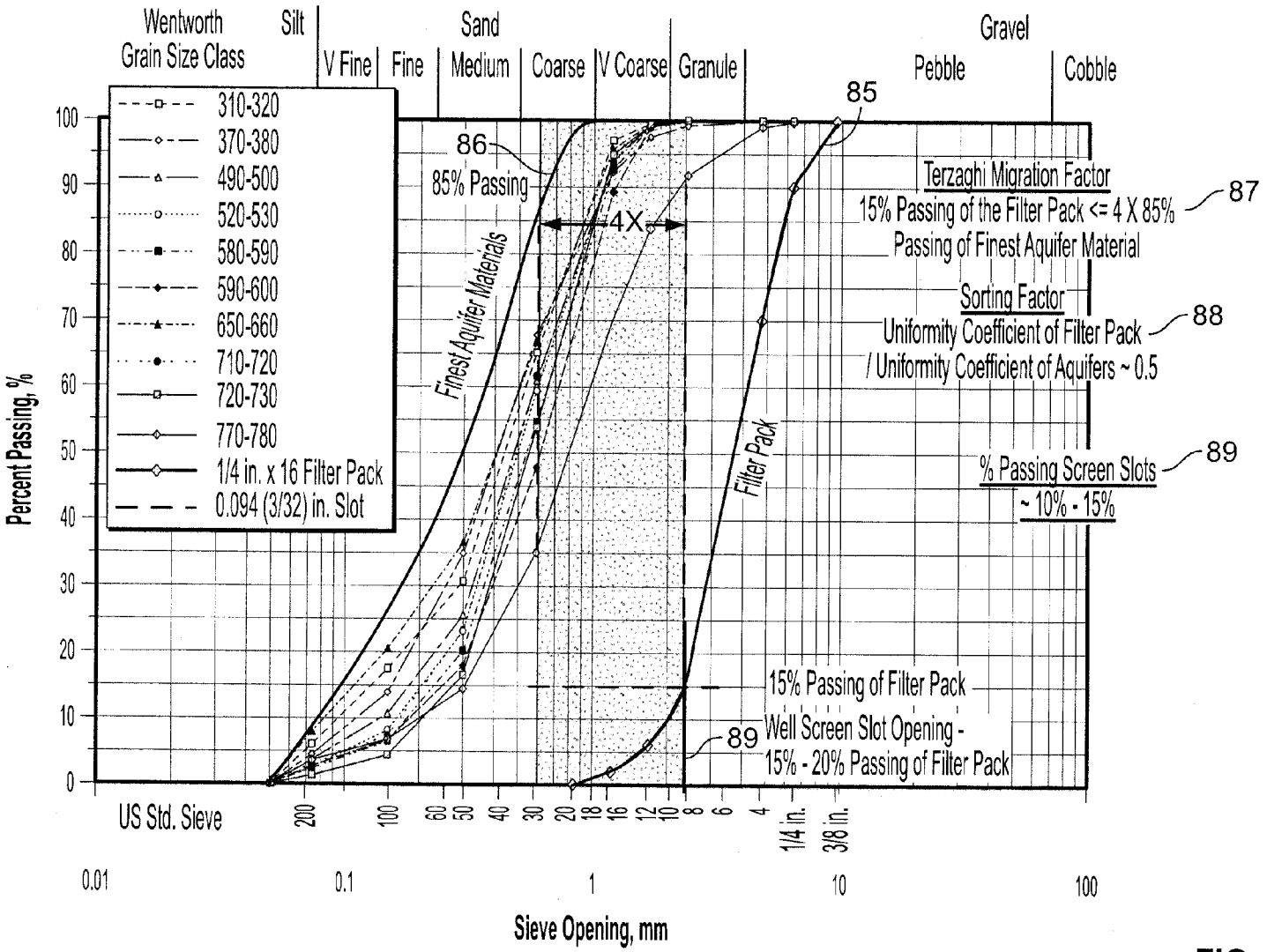
FIG. 15 is a chart of sieve opening versus percent of filter material passing the well screen slots for designing an engineered filter pack from site-specific samples of aquifer materials.

An engineered filter pack is designed to stabilize the subsea aquifer materials and, after proper development, prevent migration of fine sand and silt materials from the subsea aquifer into the well. With reference to FIG. 15, there is shown an example chart of sieve opening versus percent of filter material passing the well screen slots for designing an engineered filter pack (line 85) from site-specific samples of aquifer materials (line 86) using the Terzaghi Migration Factor 87 as well as the filter pack sorting factor 88 and percentage of filter material passing the well screen slots 89. This figure illustrates the principles behind the design of the artificial filter pack. A key purpose of the filter pack is to stabilize the aquifer. A key purpose of the well screen is to stabilize the filter pack.

To design the engineered filter pack, site-specific samples of aquifer materials are taken. It is next determined what sieve opening would pass 85 percent of the aquifer materials in the finest zone. In the example shown in FIG. 15, it is determined that a sieve opening of approximately 0.6 millimeters would pass 85 percent of the finest aquifer materials within the screened interval of the well. The grain sizes of the filter pack are then chosen such that the 15-percent-passing filter pack size is no more than four times greater than the 85-percent-passing size of the finest aquifer materials within the screened section of the well. In the example of FIG. 15, the 15-percent-passing filter pack size is 2.4 mm. The well screen slot openings are then sized such that 15 to 20 percent of the filter pack material will theoretically pass through the well screen slots. In the example shown in FIG. 15, a well screen having approximately 0.094-inch (3/32-inch or 2.4-millimeter) slots is chosen. The uniformity coefficient (60 percent passing/10 percent passing) of the filter pack is typically about half the uniformity coefficient of the aquifer This ratio is known as the Sorting Factor.

Figure 16:
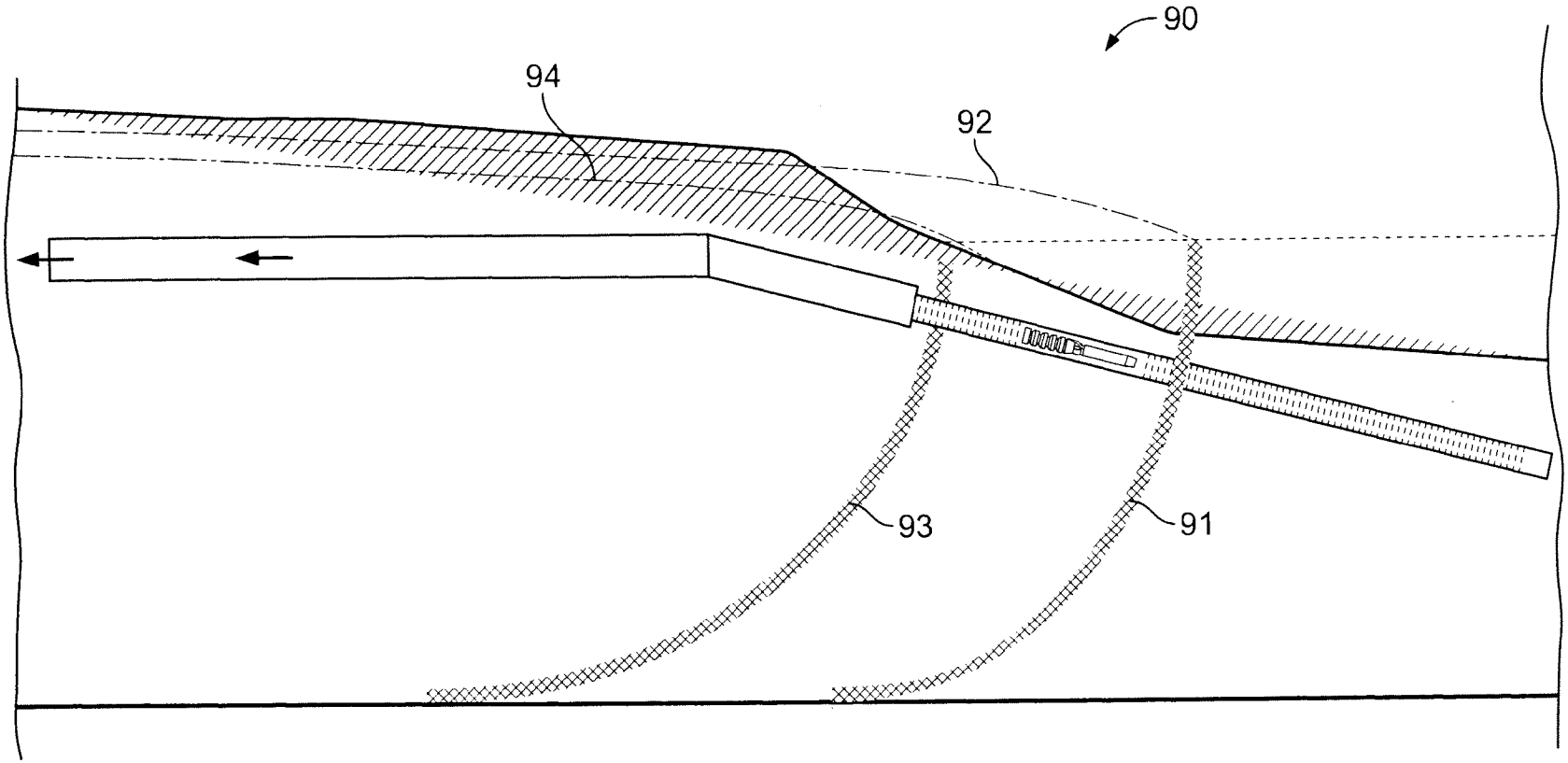
FIG. 16 is a side elevation view of a multiple-screened, telescoped slant well showing how the slant well can pump water with higher or lower salinity because of variations in the freshwater-saltwater interface due to natural variations in the hydrologic cycle, in accordance with an embodiment of the present invention, with the pump house casing cut away to show a submersible pump inside the pump house casing.

As indicated above a slant well in accordance with the present invention can have multiple screened intervals and a dual-packer shroud assembly for providing greater flexibility in feedwater production. This flexibility can become important because of variations in the freshwater-saltwater interface due to national variations in the hydrologic cycle and a need to provide water of uniform salinity to a desalination plant. With reference to FIG. 16, there is shown a multiple-screened, telescoped slant well 90 having multiple well screens, in accordance with an embodiment of the present invention. FIG. 16 illustrates how, without a means to vary the intake locations, a slant well can pump water with higher or lower salinity because of variations in the freshwater-saltwater interface due to natural variations in the hydrologic cycle. During wet hydrologic cycles, the freshwater-saltwater interface (line 91) is farther from the shore due to the higher freshwater hydraulic head (line 92). During dry hydrologic periods, the freshwater-saltwater interface (line 93) is closer to the shore due to a lower freshwater hydraulic head (line 94). The movement of the freshwater-saltwater interface is generally governed by the Ghyben-Herzberg principle, i.e., the depth to the interface (below sea level) is forty times the height of the freshwater head above sea level.

Figure 17:
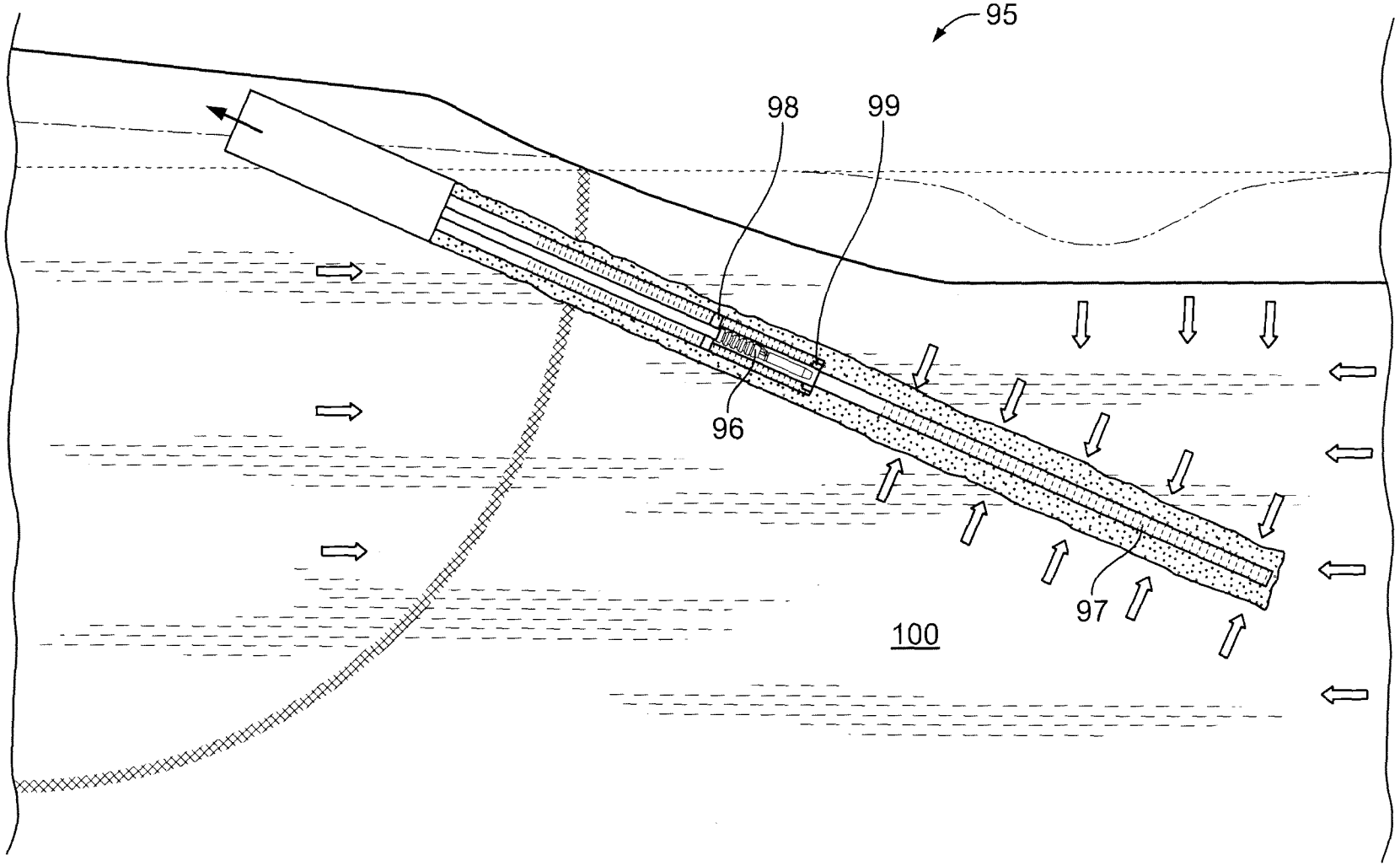
FIG. 17 is a side elevation view of a multi-screened, telescoped slant well equipped with a submersible pump fitted with a dual packer shroud assembly and pumping from the lowermost screen only (upper packer inflated, lower packer deflated), in accordance with an embodiment of the present invention, with the aquifers and artificial filter pack surrounding the well screens shown in cross-section, and the pump house casing cut away to show the submersible pump and dual-packer shroud assembly.

As will now be described, multiple screened intervals and a dual-packer shroud assembly can provide greater flexibility in feedwater production and lessen the effects of variations in the hydrologic cycle. With reference to FIG. 17, there is shown a multi-screened, telescoped slant well 95 equipped with a submersible pump 96 fitted with a dual-packer shroud assembly and pumping from the lowermost screen 97 only (upper packer 98 inflated, lower packer 99 deflated), in accordance with an embodiment of the present invention. This configuration allows for greater production from the more saline portion 100 of the aquifer.

Figure 18:
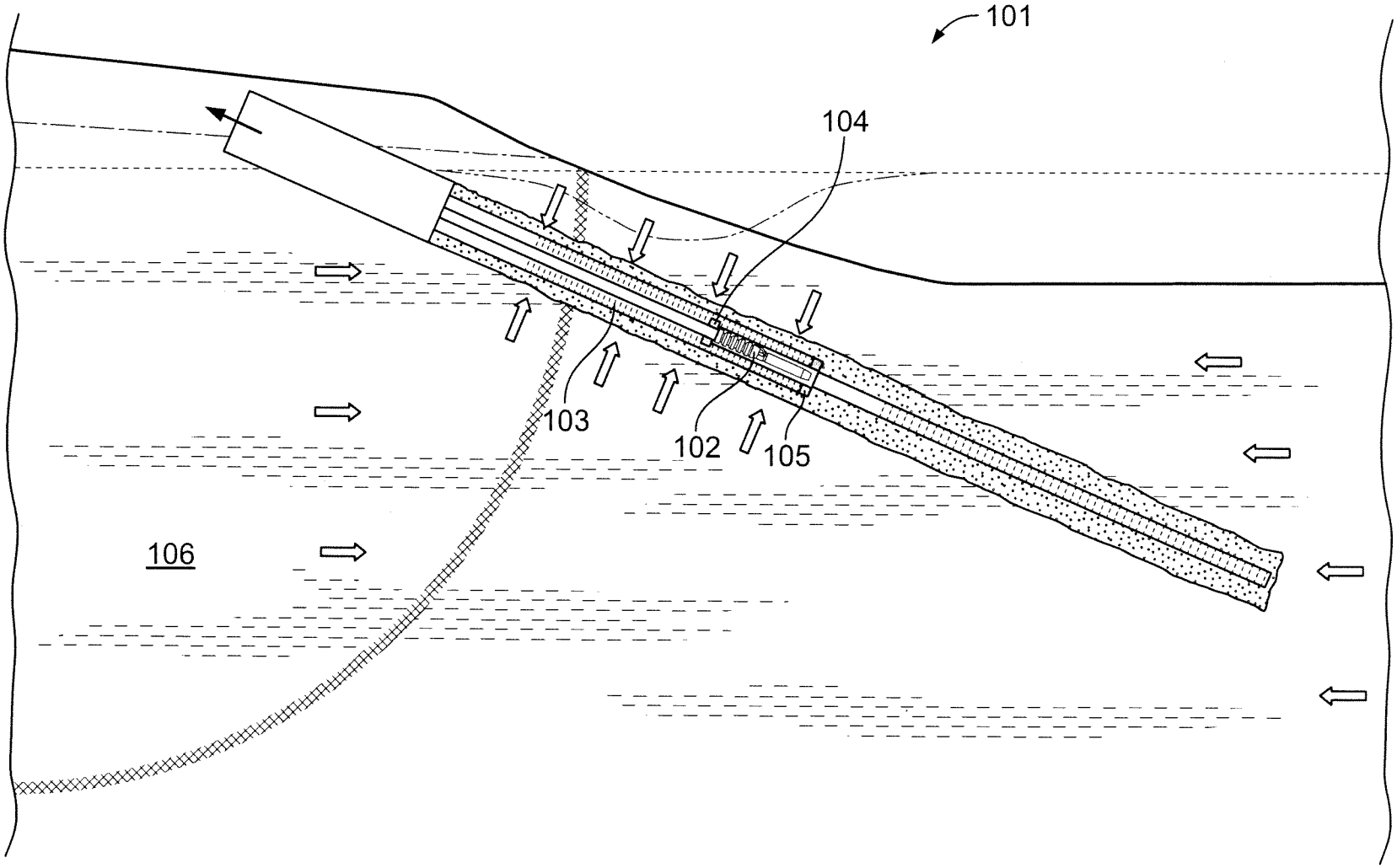
FIG. 18 is a side elevation view of a multi-screened, telescoped slant well equipped with a submersible pump fitted with a dual packer shroud assembly and pumping from the uppermost screen only (upper packer deflated, lower packer inflated), in accordance with an embodiment of the present invention, with the aquifers and artificial filter pack surrounding the well screens shown in cross-section, and the pump house casing cut away to show the submersible pump and dual-packer shroud assembly.

With reference now to FIG. 18, there is shown a multi-screened, telescoped slant well 101 equipped with a submersible pump 102 fitted with a dual-packer shroud assembly and pumping from the uppermost screen 103 only (upper packer 104 deflated, lower packer 105 inflated), in accordance with an embodiment of the present invention. This configuration allows for greater production from the less saline portion 106 of the aquifer.

Figure 19:
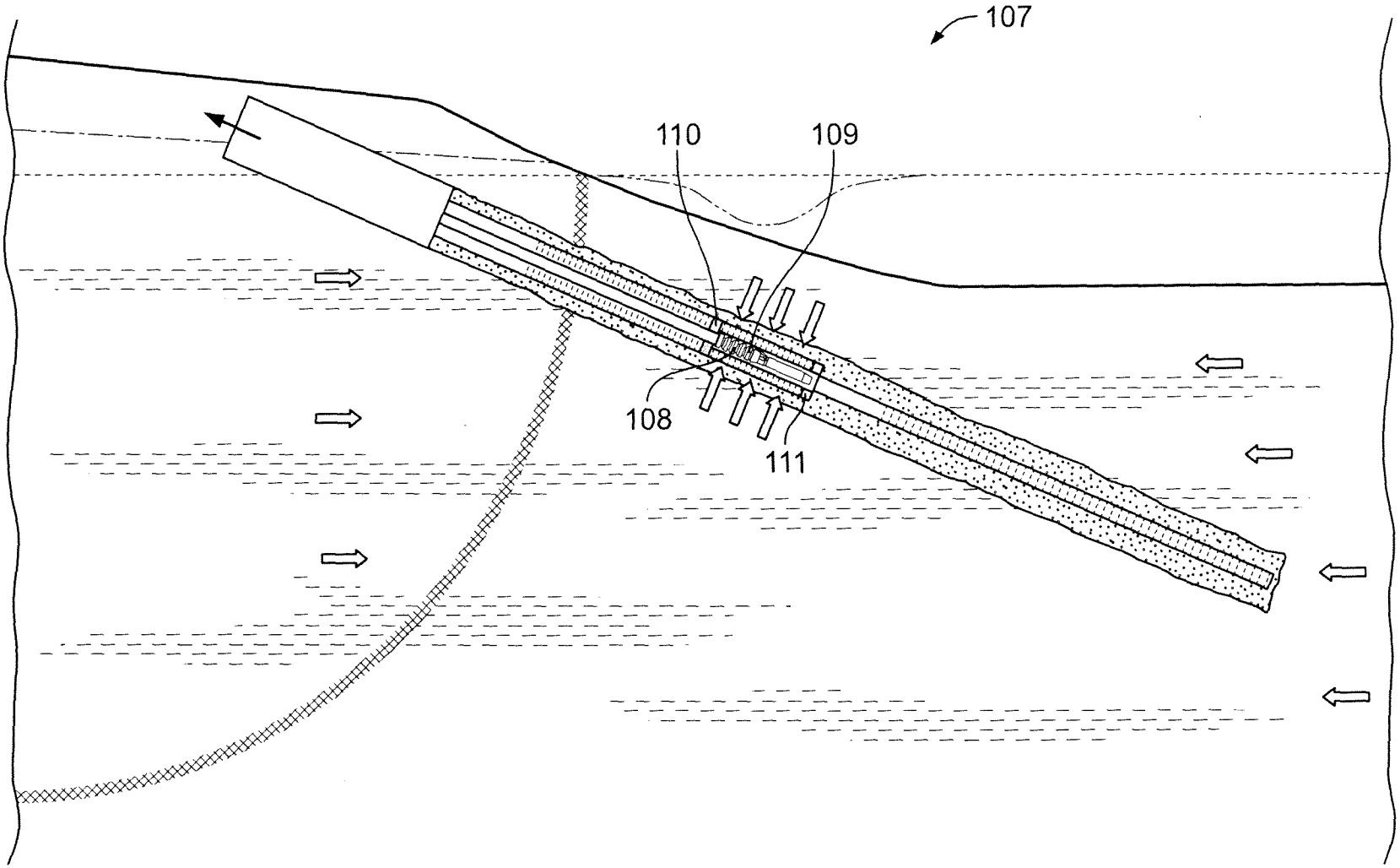
FIG. 19 is a side elevation view of a multi-screened, telescoped slant well equipped with a submersible pump fitted with a dual packer shroud assembly and pumping from the well screen portion between the dual packers (upper and lower packers inflated), in accordance with an embodiment of the present invention, with the aquifers and artificial filter pack surrounding the well screens shown in cross-section, and the pump house casing cut away to show the submersible pump and dual-packer shroud assembly.

With reference now to FIG. 19, there is shown a multi-screened, telescoped slant well 107 equipped with a submersible pump 108 fitted with a dual-packer shroud assembly and pumping from the well screen portion 109 between the dual packers (upper packer 110 and lower packer 111 inflated), in accordance with an embodiment of the present invention. This configuration allows for focused production from the portion of the aquifer proximate the well screen portion 109.

Figure 20:
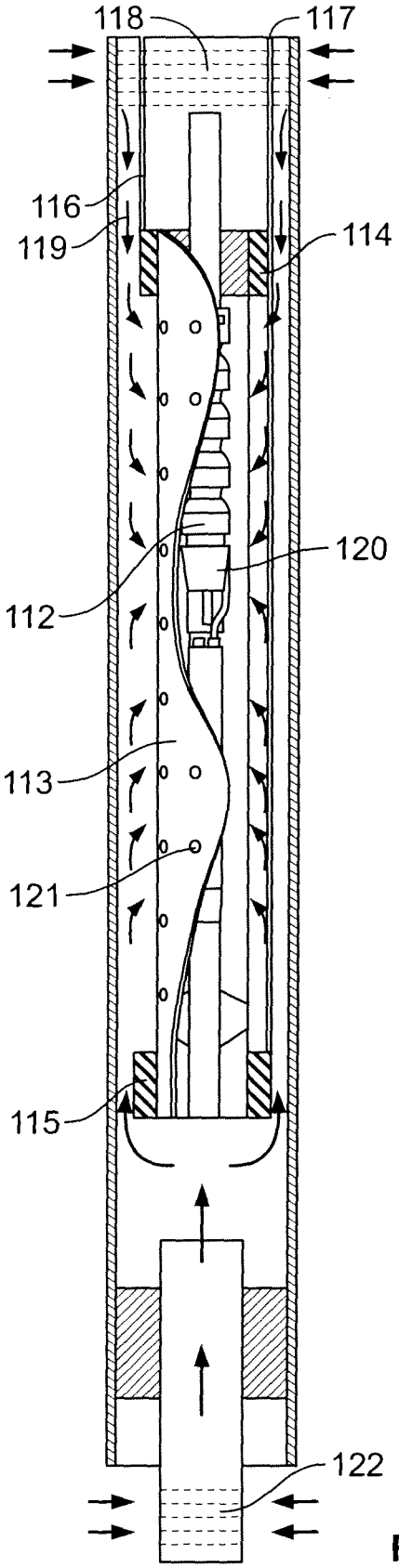
FIG. 20 is a detailed side elevation view of a portion of a well having a submersible pump fitted with a dual packer shroud assembly configured for maximum production (both upper and lower packers deflated), in accordance with an embodiment of the present invention, with portions of the well cut away to show the submersible pump.

The various configurations of the dual packer shroud assembly will now be described in greater detail with reference to FIGS. 20-23. FIG. 20 shows a portion of a well having a submersible pump 112 fitted with a dual-packer shroud assembly 113, in accordance with an embodiment of the present invention. The shroud assembly comprises two pneumatic packers: an upper packer 114 and a lower packer 115. In FIG. 20, the dual-packer shroud assembly is configured for maximum production (both upper packer 114 and lower packer 115 deflated). The upper packer is inflated and deflated using an upper packer air line 116. The lower packer is inflated and deflated using a lower packer air line 117. When both packers 114 and 115 are deflated, water enters the upper screen 118 from the aquifer and travels downward toward the pump in the annular space 119 between the upper screen and the pump discharge pipe. This upper water passes by the upper packer 114, which is deflated, and enters the pump intake 120 through holes 121 in the shroud assembly. Water entering through the lower screen 122 from the aquifer travels upward toward the pump and passes by the lower packer 115, which is deflated, and enters the pump intake through the holes 121 in the shroud assembly.

Figure 21:
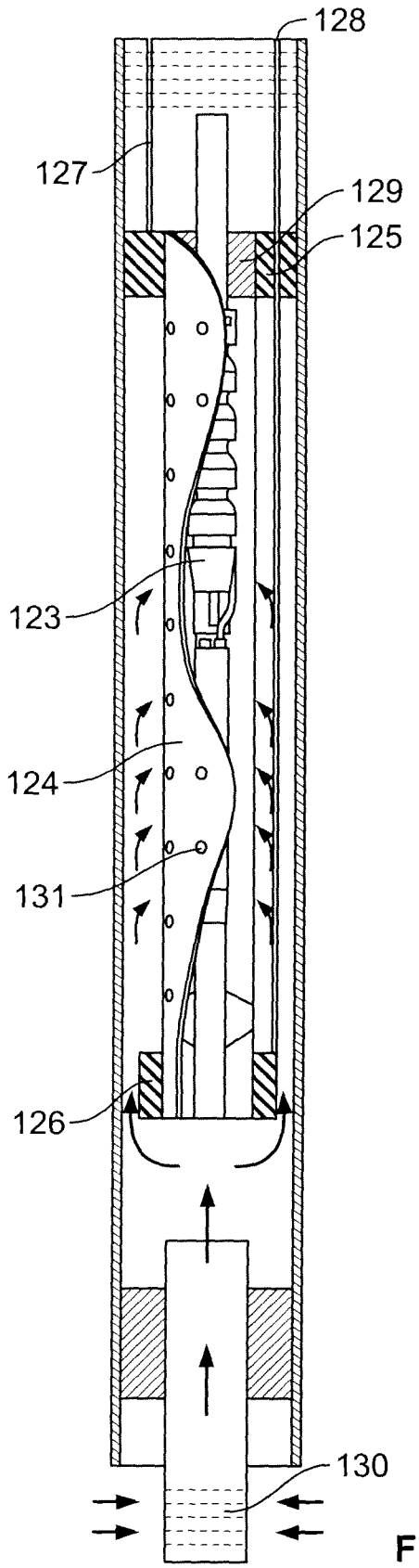
FIG. 21 is a detailed side elevation view of a portion of a well having a submersible pump fitted with a dual packer shroud assembly configured for production from below the lower packer (upper packer inflated and lower packer deflated), in accordance with an embodiment of the present invention, with portions of the well cut away to show the submersible pump.

FIG. 21 shows a portion of a well having a submersible pump 123 fitted with a dual-packer shroud assembly 124, in accordance with an embodiment of the present invention. The shourd assembly comprises two pneumatic packers: an upper packer 125 and a lower packer 126. In FIG. 21, the dual-packer shroud assembly is configured for production from below the lower packer (upper packer 125 inflated and lower packer 126 deflated). The upper packer is inflated and deflated using an upper packer air line 127. The lower packer is inflated and deflated using a lower packer air line 128. Water entering through the upper well screen is prevented from entering the pump intake by means of a permanent packer 129 and the inflated upper packer 125. Water entering through the lower screen 130 from the aquifer travels upward toward the pump and passes by the lower packer 126, which is deflated, and enters the pump intake through the holes 131 in the shroud assembly.

Figure 22:
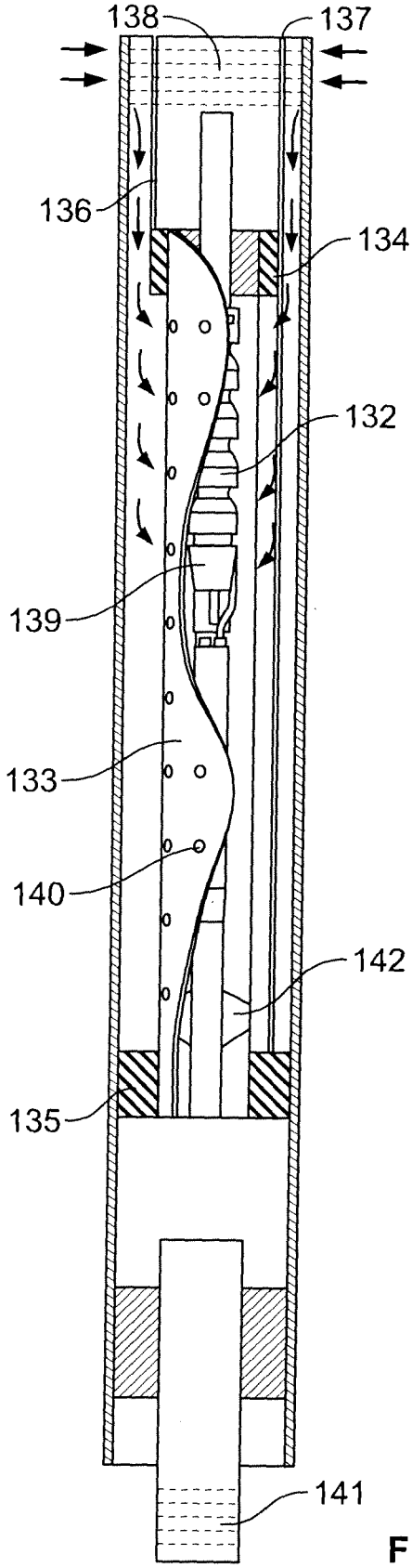
FIG. 22 is a detailed side elevation view of a portion of a well having a submersible pump fitted with a dual packer shroud assembly configured for production from above the upper packer (upper packer deflated and lower packer inflated), in accordance with an embodiment of the present invention, with portions of the well cut away to show the submersible pump.

FIG. 22 shows a portion of a well having a submersible pump 132 fitted with a dual-packer shroud assembly 133, in accordance with an embodiment of the present invention. The shroud assembly comprises two pneumatic packers: an upper packer 134 and a lower packer 135. In FIG. 22, the dual-packer shroud assembly is configured for production from above the upper packer (upper packer deflated 134 and lower packer inflated 135). The upper packer is inflated and deflated using an upper packer air line 136 extending from an air pump (not shown) to the upper packer. The lower packer is inflated and deflated using a lower packer air line 137 extending from an air pump (not shown) to the upper packer. The air pump may be a standard air pump known to persons of ordinary skill in the art, sufficient to displace a volume of gas by physical or mechanical action to inflate and deflate the upper and lower packers. Water entering through the upper screen 138 from the aquifer travels downward toward the pump intake 139 and passes by the upper packer 134, which is deflated, and enters the pump intake 139 through the holes 140 in the shroud assembly. Water entering through the lower well screen 141 is prevented from entering the pump intake by means of the inflated lower packer 135. Guides 142 center the pump within the dual-packer shroud assembly.

Figure 23:
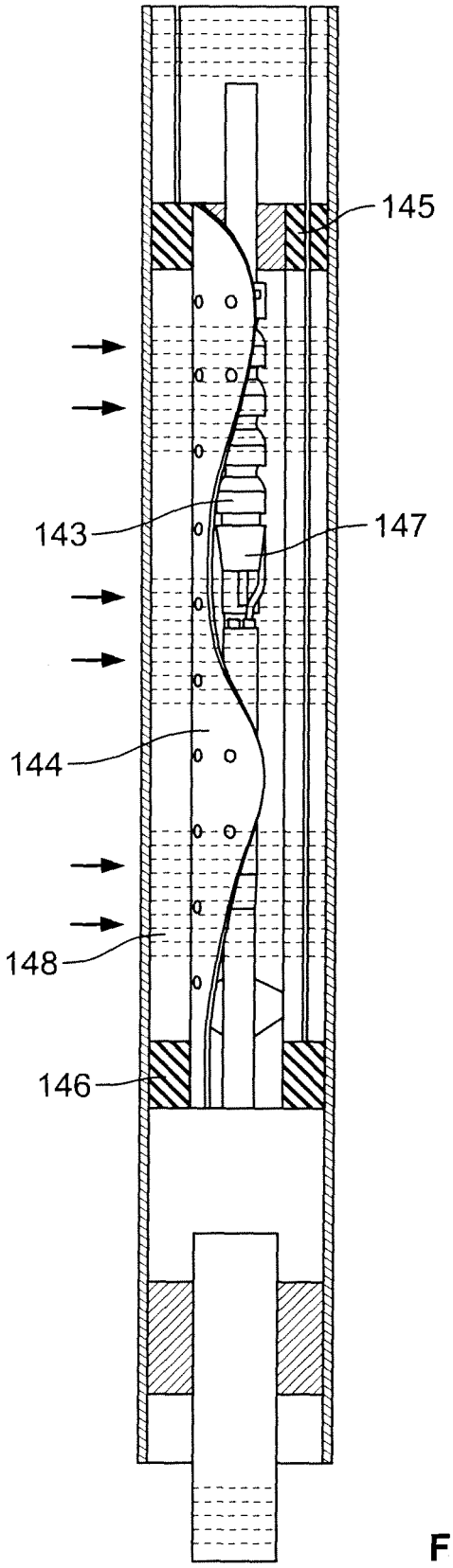
FIG. 23 is a detailed side elevation view of a portion of a well having a submersible pump fitted with a dual packer shroud assembly configured for production from between the dual packers (both upper and lower packers inflated), in accordance with an embodiment of the present invention, with portions of the well cut away to show the submersible pump.

FIG. 23 shows a portion of a well having a submersible pump 143 fitted with a dual-packer shroud assembly 144, in accordance with an embodiment of the present invention. The shroud assembly comprises two pneumatic packers: an upper packer 145 and a lower packer 146. In FIG. 23, the dual-packer shroud assembly is configured for production from between the dual packers (both upper packer 145 and lower packer 146 inflated). The upper packer is inflated and deflated using an upper packer air line. The lower packer is inflated and deflated using a lower packer air line. Water enters the pump intake 147 from the screened section 148 between the packers. Water entering through the upper or lower well screens is prevented from entering the pump intake by means of the inflated upper packer 145 and lower packer 146.

A slant well feedwater supply system in accordance with the present invention can be constructed near and/or beneath any saline water source, but more preferably is constructed where a river delta deposit meets the ocean, where a major drainage (such as a creek, stream or river) discharges into the ocean, or where an aquifer system under a land surface extends offshore. An initial field investigation is preferably conducted to determine the potential of a site to yield water for a desalination plant. This exploratory work may involve drilling boreholes and test wells to an appropriate depth both onshore and offshore to properly characterize the subsurface aquifer system, which may typically be sand and gravels but may also include secondary porosity features in consolidated rock aquifers (e.g. carbonate aquifers). In one embodiment, the boreholes and test wells are drilled 50 to 200 feet deep. The lithologic characterization of the aquifers may also indicate the quality of the water that might be supplied for a well drilled at that site (e.g., in terms of total dissolved solids (TDS), chlorides and other chemical constituents of concern in a desalination feedwater supply and how those constituents vary with depth).

In one embodiment, the slant well feedwater supply system extends at approximately a 23-degree angle below horizontal to a total length of approximately 350 feet and is capable of providing 2,000-gpm feedwater supply having an average silt density index of approximately 0.58 and an NTU between approximately 0.15 and 0.33. Of the total length, the first approximately 130 feet can comprise a blank casing, followed by approximately 220 feet of a well screen. The well screen can comprise a plurality of Roscoe Moss Full-Flo louver well screens having 3/32-inch slots, the plurality welded together end-to-end to form the complete well screen. The well screen and blank casing can have an inner diameter of 12⅛ inches and a wall thickness of 5/16-inches. In one embodiment, the well screen and blank casing comprise 316L stainless steel. The artificial filter pack can comprise Colorado Silica ¼×16 packed approximately 5 inches thick around the well screen. In one particular embodiment, the full scale system comprises a plurality of seven 1,000-foot slant wells, with each well supplying a feedwater supply of approximately 3,000 gpm for a total supply of approximately 30 mgd.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined only by the following claims.

What is claimed is:

1. A telescoping slant well system for returning water to a subsurface aquifer system, the well system comprising:

a primary well screen for injecting water into the aquifer system, the primary well screen oriented along an axis angled less than ninety degrees below horizontal and having a substantially uniform cross-sectional area;

a filter pack substantially surrounding and adjacent to the primary well screen;

a pump house casing oriented along the axis, upward of the primary well screen, and having a substantially uniform cross-sectional area; and a submersible pump contained within the pump house casing for pumping water to be injected through the primary well screen;

wherein the cross-sectional area of the pump house casing is greater than the cross-sectional area of the primary well screen.

2. The well system of claim 1, wherein the axis is straight.

3. The well system of claim 1, further comprising a secondary well screen for injecting water into the aquifer system, the secondary well screen oriented along the axis and having a substantially uniform cross-sectional area greater than the cross-sectional area of the primary well screen.

4. The well system of claim 3, further comprising a dual-packer assembly contained within the pump house casing, the dual-packer assembly comprising:

a first packer for regulating the flow of water from the submersible pump to the primary well screen; and a second packer for regulating the flow of water from the submersible pump to the secondary well screen.

5. The well system of claim 4, wherein:

the first packer is a first pneumatic packer; and the second packer is a second pneumatic packer.

6. The well system of claim 5, further comprising:

a first air line configured to extend from a first air pump to the first pneumatic packer for inflating and deflating the first pneumatic packer; and a second air line configured to extend from a second air pump to the second pneumatic packer for inflating and deflating the second pneumatic packer.

7. The well system of claim 4, further comprising a tertiary well screen for injecting water into the aquifer system, the tertiary well screen oriented along the axis between the first packer and the second packer.

8. The well system of claim 4, wherein:

the dual-packer assembly further comprises a shroud substantially surrounding the submersible pump; and the shroud has a plurality of holes.

9. The well system of claim 8, wherein the dual-packer assembly further comprises centering guides attached to the shroud for centering the submersible pump within the shroud.

10. A telescoping horizontally directionally drilled well system for supplying water from or returning water to a subsurface aquifer system, the well system comprising:

a primary well screen for initially admitting water from or injecting water into the aquifer system, the primary well screen extending substantially non-vertically within the aquifer system and having a substantially uniform cross-sectional area;

a filter pack substantially surrounding and adjacent to the primary well screen;

a pump house casing located upward of the primary well screen and having a substantially uniform cross-sectional area; and a submersible pump contained within the pump house casing for pumping water admitted or to be injected through the primary well screen;

wherein the cross-sectional area of the pump house casing is greater than the cross-sectional area of the primary well screen.

11. The well system of claim 10, further comprising a secondary well screen for initially admitting water from or injecting water into the aquifer system, the secondary well screen extending substantially non-vertically within the aquifer system and having a substantially uniform cross-sectional area greater than the cross-sectional area of the primary well screen.

12. The well system of claim 11, further comprising a dual-packer assembly contained within the pump house casing, the dual-packer assembly comprising:

a first packer for regulating the flow of water with respect to the primary well screen; and a second packer for regulating the flow of water with respect to the secondary well screen.

13. The well system of claim 12, wherein:

the first packer is a first pneumatic packer; and the second packer is a second pneumatic packer.

14. The well system of claim 13, further comprising:

a first air line configured to extend from a first air pump to the first pneumatic packer for inflating and deflating the first pneumatic packer; and a second air line configured to extend from a second air pump to the second pneumatic packer for inflating and deflating the second pneumatic packer.

15. The well system of claim 12, further comprising a tertiary well screen for initially admitting water from or injecting water into the aquifer system, the tertiary well screen extending substantially non-vertically within the aquifer system and located between the first packer and the second packer.

16. The well system of claim 12, wherein:

the dual-packer assembly further comprises a shroud substantially surrounding the submersible pump; and the shroud has a plurality of holes.

17. The well system of claim 16, wherein the dual-packer assembly further comprises centering guides attached to the shroud for centering the submersible pump within the shroud.

18. A telescoping slant well system for supplying water from or returning water to a subsurface aquifer system, the well system comprising:

a primary well screen for admitting water from or injecting water into the aquifer system, the primary well screen oriented along an axis angled less than ninety degrees below horizontal and having a substantially uniform cross-sectional area;

a secondary well screen for admitting water from or injecting water into the aquifer system, the secondary well screen oriented along the axis and having a substantially uniform cross-sectional area;

a filter pack substantially surrounding and adjacent to the primary well screen and the secondary well screen;

a pump house casing oriented along the axis, upward of the primary well screen, and having a substantially uniform cross-sectional area;

a submersible pump contained within the pump house casing for pumping water admitted or to be injected through the primary well screen; and a dual-packer assembly contained within the pump house casing, the dual-packer assembly comprising a first packer for regulating the flow of water with respect to the primary well screen; and a second packer for regulating the flow of water with respect to the secondary well screen;

wherein the cross-sectional area of the pump house casing is greater than the cross-sectional area of the primary well screen.

19. The well system of claim 18, wherein:

the first packer is a first pneumatic packer; and the second packer is a second pneumatic packer.

20. The well system of claim 19, further comprising:

a first air line configured to extend from a first air pump to the first pneumatic packer for inflating and deflating the first pneumatic packer; and a second air line configured to extend from a second air pump to the second pneumatic packer for inflating and deflating the second pneumatic packer.

21. The well system of claim 18, further comprising a tertiary well screen for admitting water from or injecting water into the aquifer system, the tertiary well screen oriented along the axis between the first packer and the second packer.

22. The well system of claim 18, wherein:

the dual-packer assembly further comprises a shroud substantially surrounding the submersible pump; and the shroud has a plurality of holes.

23. The well system of claim 22, wherein the dual-packer assembly further comprises centering guides attached to the shroud for centering the submersible pump within the shroud.

24. A method of constructing a well system for supplying water from or returning water to an aquifer, the method comprising the steps of:

placing a telescoping plurality of casings below a land surface so that the telescoping plurality of casings extends substantially non-vertically beneath a water body, wherein the telescoping plurality of casings comprises one or more temporary casings;

placing a well screen within the one or more temporary casings so that a space is formed between the well screen and the one or more temporary casings, the well screen comprising a first portion having a substantially uniform cross-sectional area and a second portion having a substantially uniform cross-sectional area greater than the cross-sectional area of the first portion; and placing a filter pack in the space between the well screen and the one or more temporary casings.

25. The method of claim 24, further comprising the step of withdrawing the one or more temporary casings.

26. The method of claim 24, wherein the step of placing the well screen comprises the step of centering the well screen within the one or more temporary casings using centering guides.

27. The method of claim 24, wherein, in the step of placing a telescoping plurality of casings, the telescoping plurality of casings further comprises a pump house casing.

28. The method of claim 27, wherein:

the pump house casing has an upward end and a downward end; and the step of placing the well screen comprises placing the well screen so that the well screen extends upwardly through the downward end of the pump house casing.

29. The method of claim 28, further comprising the step of fitting the downward end of the pump house casing with a seal, the well screen extending upwardly through the seal.

30. The method of claim 24, wherein the step of placing the filter pack comprises the steps of:

extending one or more tremie pipes to the space between the well screen and the one or more temporary casings; and pumping filter pack material under pressure through the one or more tremie pipes into the space between the well screen and the one or more temporary casings.

31. The method of claim 30, wherein the step of extending the one or more tremie pipes comprises the step of positioning the one or more tremie pipes within the one or more temporary casings using tremie pipe guides.

32. The method of claim 31, wherein:

the one or more tremie pipes consist of three tremie pipes; and the step of positioning the tremie pipes comprises spacing the tremie pipes uniformly about the well screen.

33. The method of claim 30, wherein the step of placing the filter pack further comprises the steps of:

placing a packer assembly within the well screen, the packer assembly comprising a packer and a water pipe extending through a hole in the packer; and pumping water through the water pipe to settle the filter pack material.

34. The method of claim 33, further comprising the step of withdrawing the packer assembly and the one or more tremie pipes.

35. The method of claim 34, further comprising the step of withdrawing the one or more temporary casings;

wherein the steps of withdrawing the one or more temporary casings and withdrawing the packer assembly and the one or more tremie pipes are gradually performed as the steps of pumping and settling filter pack material are performed, so that the filter pack is placed and settled along the length of the well screen.

36. A method of constructing a well system for supplying water from returning water to an aquifer, the method comprising the steps of:

placing a telescoping plurality of casings below a land surface so that the telescoping plurality of casings extends substantially non-vertically beneath a water body, wherein the telescoping plurality of casings comprises one or more temporary casings and a pump house casing, the pump house casing having an upward end and a downward end;

placing a well screen within the one or more temporary casings so that a space is formed between the well screen and the one or more temporary casings and so that the well screen extends upwardly through the downward end of the pump house casing; and placing a filter pack in the space between the well screen and the one or more temporary casings.

37. The method of claim 36, further comprising the step of withdrawing the one or more temporary casings.

38. The method of claim 36, wherein the step of placing the well screen comprises the step of centering the well screen within the one or more temporary casings using centering guides.

39. The method of claim 36, further comprising the step of fitting the downward end of the pump house casing with a seal, the well screen extending upwardly through the seal.

40. The method of claim 36, wherein the step of placing the filter pack comprises the steps of:

extending one or more tremie pipes to the space between the well screen and the one or more temporary casings; and pumping filter pack material under pressure through the one or more tremie pipes into the space between the well screen and the one or more temporary casings.

41. The method of claim 40, wherein the step of extending the one or more tremie pipes comprises the step of positioning the one or more tremie pipes within the one or more temporary casings using tremie pipe guides.

42. The method of claim 41, wherein:

the one or more tremie pipes consist of three tremie pipes; and the step of positioning the tremie pipes comprises spacing the tremie pipes uniformly about the well screen.

43. The method of claim 40, wherein the step of placing the filter pack further comprises the steps of:

placing a packer assembly within the well screen, the packer assembly comprising a packer and a water pipe extending through a hole in the packer; and pumping water through the water pipe to settle the filter pack material.

44. The method of claim 43, further comprising the step of withdrawing the packer assembly and the one or more tremie pipes.

45. The method of claim 44, further comprising the step of withdrawing the one or more temporary casings;

wherein the steps of withdrawing the one or more temporary casings and withdrawing the packer assembly and the one or more tremie pipes are gradually performed as the steps of pumping and settling filter pack material are performed, so that the filter pack is placed and settled along the length of the well screen.

46. A method of constructing a well system for supplying water from or returning water to an aquifer, the method comprising the steps of:

placing a telescoping plurality of casings below a land surface so that the telescoping plurality of casings extends substantially non-vertically to beneath a water body, wherein the telescoping plurality of casings comprises one or more temporary casings;

placing a well screen within the one or more temporary casings so that a space is formed between the well screen and the one or more temporary casings;

placing a filter pack in the space between the well screen and the one or more temporary casings; and withdrawing the one or more temporary casings;

wherein the step of placing the filter pack comprises the steps of extending one or more tremie pipes to the space between the well screen and the one or more temporary casings, pumping filter pack material under pressure through the one or more tremie pipes into the space between the well screen and the one or more temporary casings, placing a packer assembly within the well screen, the packer assembly comprising a packer and a water pipe extending through a hole in the packer, pumping water through the water pipe to settle the filter pack material, and withdrawing the packer assembly and the one or more tremie pipes;

wherein the steps of withdrawing the one or more temporary casings and withdrawing the packer assembly and the one or more tremie pipes are gradually performed as the steps of pumping and settling filter pack material are performed, so that the filter pack is placed and settled along the length of the well screen.

47. The method of claim 46, wherein the step of placing the well screen comprises the step of centering the well screen within the one or more temporary casings using centering guides.

48. The method of claim 46, wherein, in the step of placing a telescoping plurality of casings, the telescoping plurality of casings further comprises a pump house casing.

49. The method of claim 48, wherein:

the pump house casing has an upward end and a downward end; and the step of placing the well screen comprises placing the well screen so that the well screen extends upwardly through the downward end of the pump house casing.

50. The method of claim 49, further comprising the step of fitting the downward end of the pump house casing with a seal, the well screen extending upwardly through the seal.

51. The method of claim 46, wherein the step of extending the one or more tremie pipes comprises the step of positioning the one or more tremie pipes within the one or more temporary casings using tremie pipe guides.

52. The method of claim 51, wherein:

the one or more tremie pipes consist of three tremie pipes; and the step of positioning the tremie pipes comprises spacing the tremie pipes uniformly about the well screen.

* * * * *